US011462166B2

(12) United States Patent
Shin et al.

(10) Patent No.: US 11,462,166 B2
(45) Date of Patent: Oct. 4, 2022

(54) DISPLAY APPARATUS

(71) Applicant: LG Display Co., Ltd., Seoul (KR)

(72) Inventors: Yeonwoo Shin, Paju-si (KR); JungHyun Lee, Paju-si (KR); Yewon Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/015,597

(22) Filed: Sep. 9, 2020

(65) Prior Publication Data

US 2021/0074218 A1 Mar. 11, 2021

(30) Foreign Application Priority Data

Sep. 10, 2019 (KR) ..... 10-2019-0111876

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2310/0297* (2013.01)

(58) Field of Classification Search
CPC .. G09G 3/3258; G09G 3/3266; G09G 3/3275; G09G 2310/0297
See application file for complete search history.

(56) References Cited

U.S. PATENT DOCUMENTS

2005/0270257 A1* 12/2005 Shin ..... G09G 3/3275 345/76
2014/0198135 A1* 7/2014 Eom ..... G09G 3/3275 345/690
2016/0293093 A1* 10/2016 Seo ..... G09G 3/20
2016/0329025 A1* 11/2016 Park ..... G09G 3/3648
2018/0301104 A1* 10/2018 Hao ..... G09G 3/3685
2019/0305071 A1* 10/2019 Yamamoto ..... H01L 27/3276

* cited by examiner

*Primary Examiner* — Michael A Faragalla
*Assistant Examiner* — Sujit Shah
(74) *Attorney, Agent, or Firm* — Morgan, Lewis & Bockius LLP

(57) ABSTRACT

A display apparatus includes first to third demultiplexer circuits respectively providing a data signal, supplied from a data driver, to three data lines. Each of the first to third demultiplexer circuits includes a switching unit providing the data signal to a corresponding data line of the three data lines on the basis of a voltage of a corresponding control line of first to third control lines, a voltage controller controlling the voltage of the corresponding control line in response to a corresponding time division control signal of first to third time division control signals and a corresponding auxiliary signal of first to third auxiliary signals which partially overlap the first to third time division control signals respectively, and a voltage discharger discharging the voltage of the corresponding control line.

20 Claims, 13 Drawing Sheets

DISPLAY APPARATUS

CROSS-REFERENCE TO RELATED APPLICATIONS

This application claims the benefit of the Korean Patent Application No. 10-2019-0111876 filed on Sep. 10, 2019, which is hereby incorporated by reference as if fully set forth herein.

BACKGROUND

Technical Field

The present disclosure relates to a display apparatus.

Discussion of the Related Art

Display apparatuses are being widely used as a display screen for notebook computers, tablet computers, smartphones, portable display apparatuses, and portable information devices as well as display apparatuses of televisions (TVs) or monitors.

Such display apparatuses include a display panel, a driving integrated circuit (IC) for driving the display panel, and a scan driving circuit for driving the display panel. The display panel includes a plurality of subpixels which are respectively provided in a plurality of pixel areas defined by a plurality of data lines and a plurality of gate lines and each include a thin film transistor (TFT). In this case, at least three adjacent subpixels configure a unit pixel which displays one image.

The driving IC is connected to each of the plurality of data lines through a plurality of data link lines. The driving IC supplies a data voltage to each of the plurality of data lines. The scan driving circuit is connected to each of the plurality of gate lines through a plurality of gate link lines. The scan driving circuit supplies a scan signal to each of the plurality of gate lines.

Generally, in display apparatuses, a driving IC is mounted on a flexible circuit film so as to decrease a bezel area of a lower end, and the number of channels of the driving IC is reduced through data time division driving based on demultiplexer circuits. However, in demultiplexer circuits of the related art, charging and discharging of a voltage of a control line are not stably performed, and power consumption increases for controlling the voltage of the control line.

SUMMARY

Accordingly, embodiments of the present disclosure are directed to providing a display apparatus that substantially obviates one or more problems due to limitations and disadvantages of the related art.

An aspect of the present disclosure is directed to providing a display apparatus which includes a demultiplexer circuit unit for providing three data lines with a data signal provided from an output channel of a data driver and changes, by using the demultiplexer circuit unit, an order in which the data signal is provided to each of the three data lines, at every one horizontal period of a scan signal, thereby decreasing the number of increases and decreases in voltage of a control line and reducing power consumption.

Another aspect of the present disclosure is directed to providing a display apparatus which controls a voltage of a control line of each of first to third demultiplexer circuits on the basis of a corresponding time division control signal of three time division control signals and a corresponding auxiliary signal of three auxiliary signals and discharges a voltage of a corresponding control line on the basis of a time division control signal or an auxiliary signal for controlling a voltage of each of two other control lines, thereby decreasing the number of increases and decreases in voltage of each control line and reducing power consumption.

Another aspect of the present disclosure is directed to providing a display apparatus which oppositely changes an order in which a switching unit of each of first to third demultiplexer circuits is turned on, at every one horizontal period of a scan signal, thereby implementing RGB-BGR rendering and reducing power consumption.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a display apparatus including first to third demultiplexer circuits respectively providing a data signal, supplied from a data driver, to three data lines, wherein each of the first to third demultiplexer circuits includes a switching unit providing the data signal to a corresponding data line of the three data lines on the basis of a voltage of a corresponding control line of first to third control lines, a voltage controller controlling the voltage of the corresponding control line in response to a corresponding time division control signal of first to third time division control signals and a corresponding auxiliary signal of first to third auxiliary signals which partially overlap the first to third time division control signals respectively, and a voltage discharger discharging the voltage of the corresponding control line, and wherein an order, in which the switching unit of each of the first to third demultiplexer circuits is turned on, is oppositely changed at every one horizontal period of a scan signal.

In another aspect of the present disclosure, there is provided a display apparatus including first to third demultiplexer circuits respectively providing a data signal, supplied from a data driver, to three data lines, wherein each of the first to third demultiplexer circuits includes a switching unit providing the data signal to a corresponding data line of the three data lines on the basis of a voltage of each of first to third control lines, a voltage controller controlling the voltage of each of the first to third control lines in response to each of first to third time division control signals and each of first to third auxiliary signals which partially overlap the first to third time division control signals respectively, and a voltage discharger discharging the voltage of each of the first to third control lines, and wherein the voltage discharger of the second demultiplexer circuit includes a second transistor turned on based on the third time division control signal or the third auxiliary signal to discharge the second control line and a discharging transistor turned on based on the first time division control signal or the first auxiliary signal to additionally discharge the second control line.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

Figure 1:
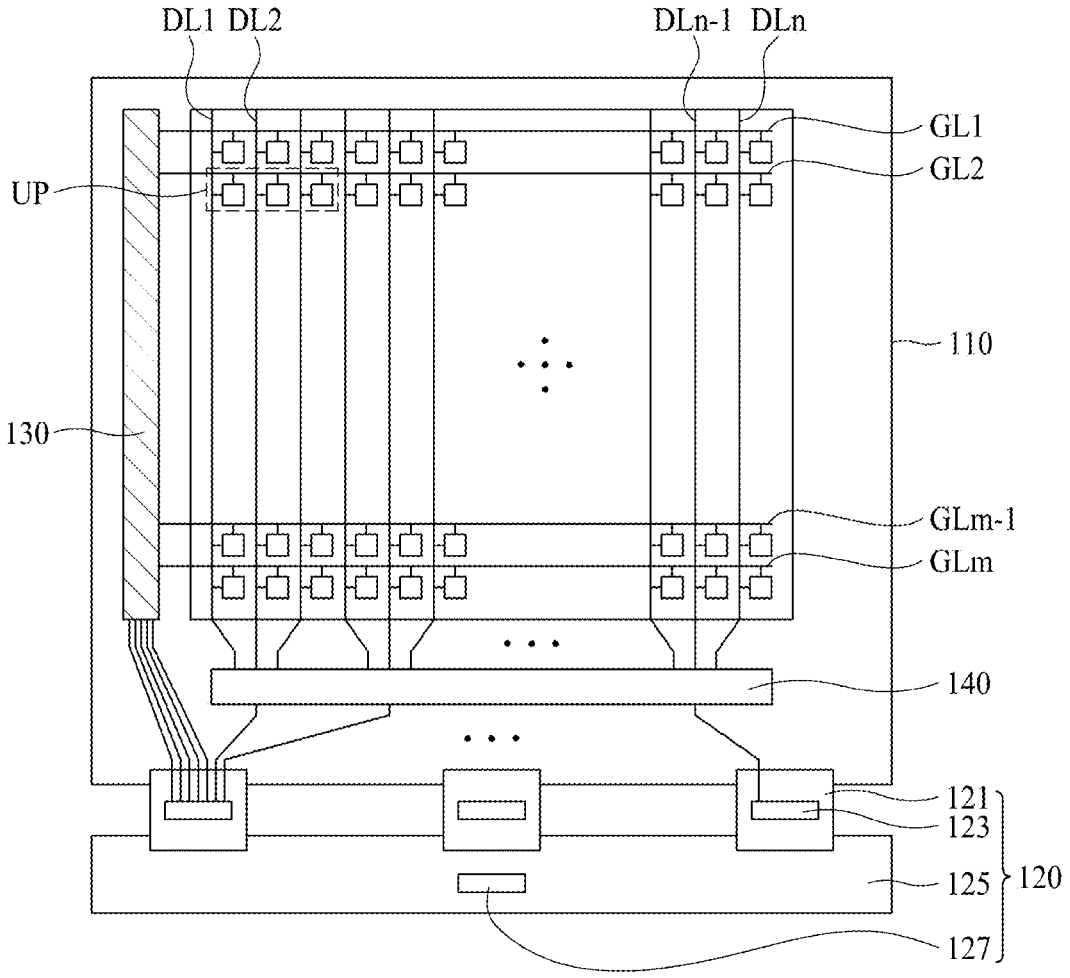
FIG. 1 is a diagram illustrating a display apparatus according to an embodiment of the present disclosure.

Reference will now be made in detail to the exemplary embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where "comprise," "have," and "include" described in the present specification are used, another part may be added unless "only" is used. The terms of a singular form may include plural forms unless referred to the contrary.

In construing an element, the element is construed as including an error range although there is no explicit description.

In describing a position relationship, for example, when a position relation between two parts is described as "on~," "over~," "under~," and "next~," one or more other parts may be disposed between the two parts unless "just" or "direct" is used.

In describing a time relationship, for example, when the temporal order is described as "after~," "subsequent~," "next~," and "before~," a case which is not continuous may be included unless "just" or "direct" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, terms such as first, second, A, B, (a), (b), etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it can be directly on or directly connected to the other element or layer, or intervening elements or layers may be present. Also, it should be understood that when one element is disposed on or under another element, this may denote a case where the elements are disposed to directly contact each other, but may denote that the elements are disposed without directly contacting each other.

The term "at least one" should be understood as including any and all combinations of one or more of the associated listed elements. For example, the meaning of "at least one of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

In the present disclosure, examples of the display apparatus may include a narrow-sense display apparatus itself, such as an LCM or an OLED module, and a set device which is a final consumer device or an application product including the LCM or the OLED module.

If the display panel is the organic light emitting display panel, the display panel may include a plurality of gate lines, a plurality of data lines, and a plurality of pixels respectively provided in a plurality of pixel areas defined by intersections of the gate lines and the data lines. Also, the display panel may include an array substrate including a TFT which is an element for selectively applying a voltage to each of the pixels, an organic light emitting device layer on the array substrate, and an encapsulation substrate disposed on the array substrate to cover the organic light emitting device layer. The encapsulation substrate may protect the TFT and the organic light emitting device layer from an external impact and may prevent water or oxygen from penetrating into the organic light emitting device layer. Also, a layer provided on the array substrate may include an inorganic light emitting layer (for example, a nano-sized material layer, a quantum dot, or the like). As another example, the layer provided on the array substrate may include a micro light emitting diode.

Hereinafter, embodiments of the present disclosure will be described in detail with reference to the accompanying drawings. In adding reference numerals to elements of each of the drawings, although the same elements are illustrated in other drawings, like reference numerals may refer to like elements. Also, for convenience of description, a scale of each of elements illustrated in the accompanying drawings differs from a real scale, and thus, is not limited to a scale illustrated in the drawings.

FIG. 1 is a plan view illustrating a display apparatus according to an embodiment of the present disclosure.

Referring to FIG. 1, the display apparatus may include a substrate 110, a data driver 120, a scan driver 130, and a demultiplexer circuit unit 140.

The substrate 110 may include glass or plastic. According to an embodiment, the substrate 110 may include transparent plastic (for example, polyimide) having a flexible characteristic.

The substrate 110 may include a plurality of pixels provided by intersections of n (where n is an integer of 2 or more) number of data lines DL1 to DLn and m (where m is an integer of 2 or more) number of gate lines GL1 to GLm. One pixel may configure a red subpixel, a green subpixel, and a blue subpixel, and adjacent red subpixel, green subpixel, and blue subpixel may configure one unit pixel UP. Each of a red subpixel, a green subpixel, and a blue subpixel may receive a data signal, including gray level information about red, green, or blue light, from the data driver 120.

The data driver 120 may include a plurality of circuit films 121, a plurality of driving integrated circuits (ICs) 123, a printed circuit board (PCB) 125, and a timing controller 127.

Each of the plurality of circuit films 121 may be attached on a pad part of the substrate 110 and the PCB 125. For example, an input terminal provided at one side of each of the plurality of circuit films 121 may be attached on the PCB 125 by a film attachment process, and an output terminal provided at the other side of each of the plurality of circuit films 121 may be attached on the pad part of the substrate 110 by a film attachment process.

Each of the plurality of driving ICs 123 may be individually mounted on a corresponding circuit film 121 of the plurality of circuit films 121. Each of the plurality of driving ICs 123 may receive pixel data and a data control signal provided from the timing controller 127, convert the pixel data into a pixel-based analog data signal on the basis of the data control signal, and provide the analog data signal to a corresponding data line.

The PCB 125 may support the timing controller 127 and may transfer a signal and power between elements of the data driver 120.

The timing controller 127 may be mounted on the PCB 125 and may receive video data and a timing synchronization signal provided from a display driving system through a user connector mounted on the PCB 125. Also, the timing controller 127 may generate each of a data control signal and a scan control signal on the basis of the timing synchronization signal, control a driving timing of each of the driving ICs 123 by using the data control signal, and control a driving timing of the scan driver 130 by using the scan control signal.

The scan driver 130 may be disposed at one edge of the substrate 110 and may be connected to each of the m gate lines GL1 to GLm. In this case, the scan driver 130 may be formed along with a process of forming a thin film transistor (TFT) of each pixel. The scan driver 130 may generate a scan signal on the basis of the gate control signal provided from the driving IC 123 and may sequentially provide the scan signal to each of the m gate lines GL1 to GLm. According to an embodiment, the scan driver 130 may include m number of stages (not shown) respectively connected to the m gate lines GL1 to GLm.

The demultiplexer circuit unit 140 may sequentially provide the data signal, supplied from the data driver 120, to at least three data lines DL. In detail, the demultiplexer circuit unit 140 may be disposed at one side of the substrate 110 so as to be connected to each of output channels of the driving IC 123 and connected to each of the n data lines DL1 to DLn provided in the substrate 110. The demultiplexer circuit unit 140 may sequentially distribute a data signal, which is input from the driving IC 123 during one horizontal period and includes gray level information about red, green, or blue light, to the n data lines DL1 to DLn.

According to an embodiment, when the demultiplexer circuit unit 140 is connected to i (where i is a natural number of 2 or more) number of control lines and the n data lines DL, the plurality of driving ICs 123 of the data driver 120 may include n/i number of output channels. Therefore, the display apparatus may include the demultiplexer circuit unit 140 connected to the i control lines, thereby decreasing the number of channels of the plurality of driving ICs 123 and implementing a high-resolution image.

Figure 2:
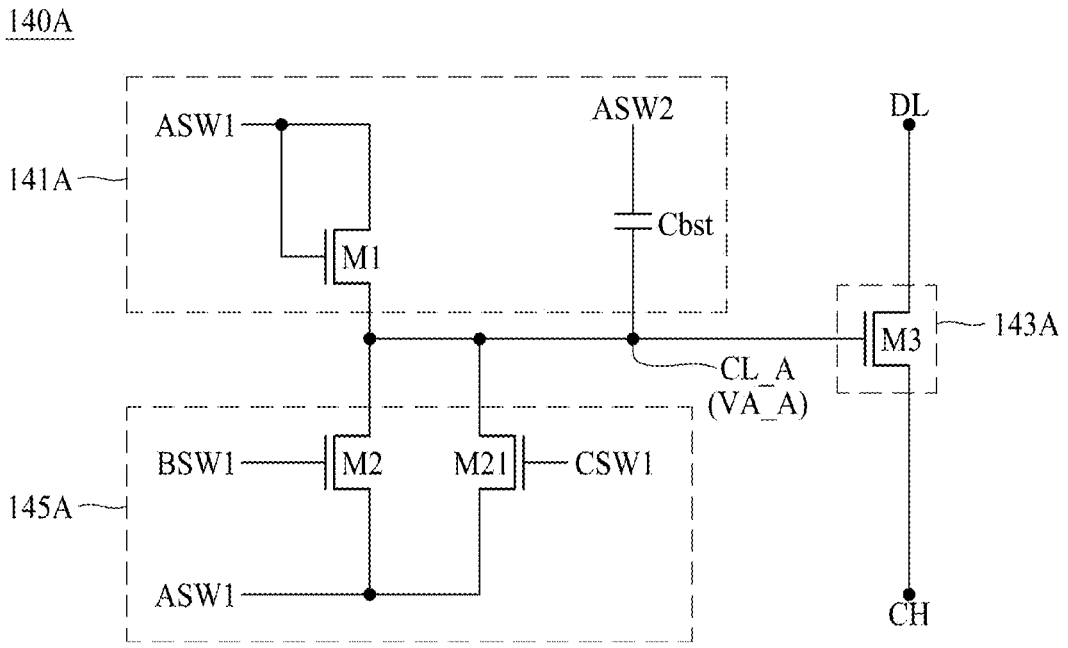
FIG. 2 is a circuit diagram illustrating a first demultiplexer circuit according to a first embodiment, in a demultiplexer circuit unit illustrated in FIG. 1.

FIG. 2 is a circuit diagram illustrating a first demultiplexer circuit according to a first embodiment, in a demultiplexer circuit unit illustrated in FIG. 1. Hereinafter, the first demultiplexer circuit among first to third demultiplexer circuits will be mainly described, and configurations of the second and third demultiplexer circuits which are the same as the first demultiplexer circuit will be briefly described or are omitted.

Referring to FIG. 2, the demultiplexer circuit unit 140 may include first to third demultiplexer circuits, and a first demultiplexer circuit 140A may include a first voltage controller 141A, a first switching unit 143A, and a first voltage discharger 145A.

The first voltage controller 141A may control a voltage VA_A of a first control line CL_A in response to a first time division control signal ASW1. Also, the first voltage controller 141A may bootstrap the voltage VA_A of the first control line CL_A in response to a first auxiliary signal ASW2 partially overlapping the first time division control signal ASW1. For example, the first voltage controller 141A may bootstrap the voltage VA_A of the first control line CL_A held by the first time division control signal ASW1 by using the first auxiliary signal ASW2, and thus, may drive the voltage VA_A of the first control line CL_A to a high voltage which is higher than the first time division control signal ASW1 and may stably maintain an output of the first demultiplexer circuit 140A.

The first voltage controller 141A may include a first transistor M1 and a capacitor Cbst.

The first transistor M1 may be turned on based on the first time division control signal ASW1 and may provide the first time division control signal ASW1 to the first control line CL_A. In detail, a drain electrode and a gate electrode of the first transistor M1 may receive the first time division control signal ASW1, and a source electrode of the first transistor M1 may be connected to the first control line CL_A. Therefore, when the first time division control signal ASW1 corresponds to a voltage, the voltage VA_A of the first control line CL_A may also maintain a high-level voltage.

The capacitor Cbst may bootstrap the voltage VA_A of the first control line CL_A on the basis of the first auxiliary signal ASW2 partially overlapping the first time division control signal ASW1. In detail, one end of the capacitor Cbst may receive the first auxiliary signal ASW2, and the other end of the capacitor Cbst may be connected to the first control line CL_A. Here, a first shift time of the first auxiliary signal ASW2 may correspond to a time between a first shift time and a second shift time of the first time division control signal ASW1. That is, the first time division control signal ASW1 may be applied to the drain electrode and the gate electrode of the first transistor M1, and then, may be applied to the one end of the capacitor Cbst. As described above, the first transistor M1 may be turned on based on the first time division control signal ASW1 and may provide the first time division control signal ASW1 to the first control line CL_A, and then, the capacitor Cbst may bootstrap the voltage VA_A of the first control line CL_A on the basis of the first auxiliary signal ASW2, whereby the first voltage controller 141A may stably maintain an output of the first demultiplexer circuit 140A. When the supply of the first auxiliary signal ASW2 to the one end of the capacitor Cbst stops, the voltage VA_A of the first control line CL_A may return to a voltage before bootstrapping. Here, the voltage before bootstrapping may correspond to a voltage held by the first time division control signal ASW1.

The first switching unit 143A may sequentially provide a data signal, supplied from the data driver 120, to at least three data lines DL on the basis of the voltage VA_A of the first control line CL_A. The first switching unit 143A may include a third transistor M3.

The third transistor M3 may be turned on based on the voltage VA_A of the first control line CL_A and may provide a data signal, received from an output channel CH of the driving IC 123, to at least three data lines DL. In detail, a gate electrode of the third transistor M3 may be connected to the first control line CL_A, a drain electrode of the third transistor M3 may be connected to the output channel CH of the driving IC 123, and a source electrode of the third transistor M3 may be connected to a data line DL. Accordingly, the third transistor M3 may be turned on while the first control line CL_A has a high-level voltage on the basis of the first time division control signal ASW1 and is being bootstrapped based on the first auxiliary signal ASW2, and thus, may provide the data signal to at least three data lines DL.

According to an embodiment, the third transistor M3 may be turned on from the first shift time of the first time division control signal ASW1 to a first shift time of a second time division control signal BSW1 which does not overlap the first time division control signal ASW1, and may provide three data lines with a data signal including gray level information about red, green, or blue light. In detail, the first control line CL_A may be charged by the first transistor M1 from an application time of the first time division control signal ASW1 and may be discharged by the second transistor M2 from an application time of the second time division control signal BSW1, and thus, may be turned on from the first shift time of the first time division control signal ASW1 to the first shift time of the second time division control signal BSW1.

The first voltage discharger 145A may discharge the voltage VA_A of the first control line CL_A in response to the second time division control signal BSW1 which does not overlap the first time division control signal ASW1. Also, the first voltage discharger 145A may additionally discharge the voltage VA_A of the first control line CL_A on the basis of a third time division control signal CSW1 which does not overlap the first time division control signal ASW1 and the second time division control signal BSW1. For example, the first voltage discharger 145A may primarily discharge the voltage VA_A of the first control line CL_A on the basis of the second time division control signal BSW1, and then, may secondarily discharge the voltage VA_A of the first control line CL_A on the basis of the third time division control signal CSW1, thereby enhancing the discharging efficiency of the first demultiplexer circuit 140A to prevent the occurrence of a leakage current transferred to a light emitting device.

The first voltage discharger 145A may include a second transistor M2 and a first discharging transistor M21.

The second transistor M2 may be turned on based on the second time division control signal BSW1 which does not overlap the first time division control signal ASW1 and may discharge the voltage VA_A of the first control line CL_A. In detail, a gate electrode of the second transistor M2 may receive the second time division control signal BSW1, a drain electrode of the second transistor M2 may be connected to the first control line CL_A, and a source electrode of the second transistor M2 may receive the first time division control signal ASW1. In this case, the first time division control signal ASW1 and the second time division control signal BSW1 may be applied at different times, and thus, when the second time division control signal BSW1 corresponds to a high-level voltage, the first time division control signal ASW1 corresponds to a low-level voltage. When the second time division control signal BSW1 having a high-level voltage is applied to the gate electrode of the second transistor M2, the second transistor M2 may be turned on, and the first time division control signal ASW1 having a low-level voltage may be applied to the source electrode of the second transistor M2, whereby the voltage VA_A of the first control line CL_A may be discharged.

The first discharging transistor M21 may be turned on based on the third time division control signal CSW1 which does not overlap the first time division control signal ASW1 and the second time division control signal BSW1 and may additionally discharge the voltage VA_A of the first control line CL_A. In detail, a gate electrode of the first discharging transistor M21 may receive the third time division control signal CSW1, a drain electrode of the first discharging transistor M21 may be connected to the first control line CL_A, and a source electrode of the first discharging transistor M21 may receive the first time division control signal ASW1. Here, a first shift time of the third time division control signal CSW1 may not overlap the first time division control signal ASW1 and the second time division control signal BSW1. As described above, the second transistor M2 may primarily discharge the voltage VA_A of the first control line CL_A on the basis of the second time division control signal BSW1, and then, the first discharging transistor M21 may secondarily discharge the voltage VA_A of the first control line CL_A on the basis of the third time division control signal CSW1, whereby the first voltage discharger 145A may enhance the discharging efficiency of the first demultiplexer circuit 140A to prevent the occurrence of a leakage current transferred to an organic light emitting device.

Figure 3:
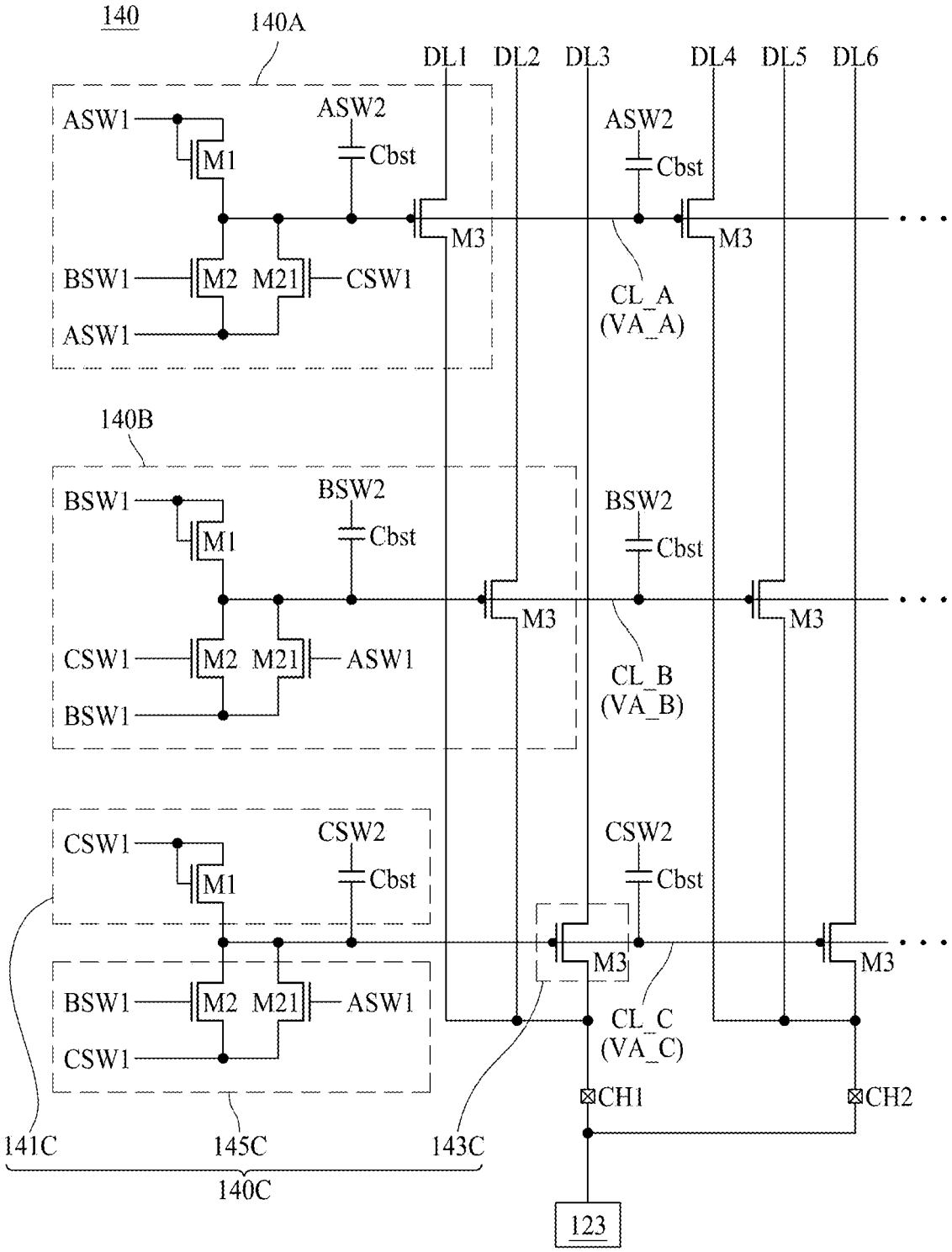
FIG. 3 is a circuit diagram illustrating an embodiment where first to third demultiplexer circuits drive a data line, in a demultiplexer circuit unit illustrated in FIG. 2.
Figure 4:
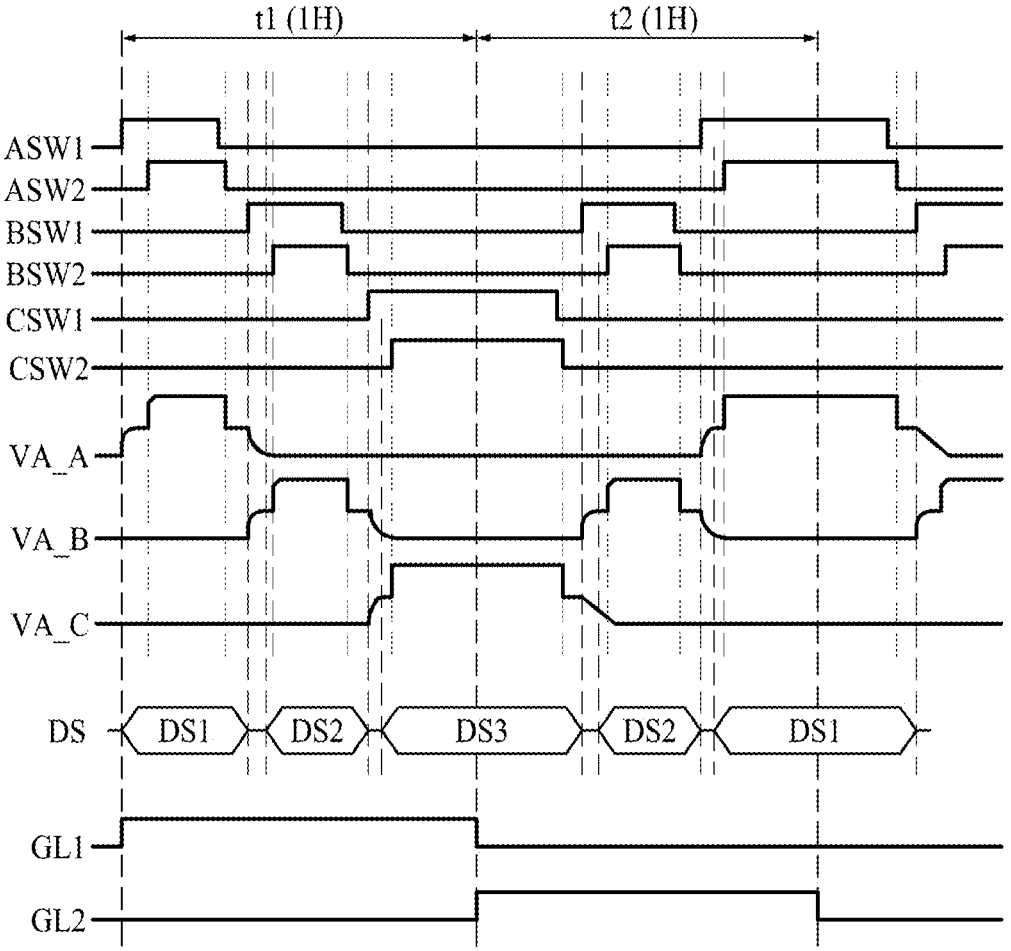
FIG. 4 is a waveform diagram showing signals provided to a demultiplexer circuit unit illustrated in FIG. 3.

FIG. 3 is a circuit diagram illustrating an embodiment where first to third demultiplexer circuits drive a data line, in the demultiplexer circuit unit illustrated in FIG. 2, and FIG. 4 is a waveform diagram showing signals provided to a demultiplexer circuit unit illustrated in FIG. 3.

Referring to FIGS. 3 and 4, when a demultiplexer circuit unit 140 is connected to first to third control lines CL_A, CL_B, and CL_C and is connected to n number of data lines DL, the plurality of driving ICs 123 of the data driver 120 may include n/3 number of output channels CH. Therefore, a display apparatus may include the demultiplexer circuit unit 140 connected to the first to third control lines CL_A, CL_B, and CL_C, and thus, comparing with a case where the display apparatus does not include the demultiplexer circuit unit 140, the number of output channels CH of the plurality of driving ICs 123 may decrease by ⅓ and a high-resolution image may be implemented.

The demultiplexer circuit unit 140 may include first to third demultiplexer circuits 140A to 140C respectively connected to the three data lines DL.

The first demultiplexer circuit 140A may include a first voltage controller 141A, a first switching unit 143A, and a first voltage discharger 145A, which are connected to a first control line CL_A. The second demultiplexer circuit 140B may include a second voltage controller, a second switching unit, and a second voltage discharger, which are connected to a second control line CL_B. The third demultiplexer circuit 140C may include a third voltage controller 141C, a third switching unit 143C, and a third voltage discharger 145C, which are connected to a third control line CL_C.

A first transistor M1 of the first voltage controller 141A may be turned on based on a first time division control signal ASW1 and may provide the first time division control signal ASW1 to the first control line CL_A, and a capacitor Cbst of the first voltage controller 141A may bootstrap a voltage VA_A of the first control line CL_A on the basis of a first auxiliary signal ASW2 partially overlapping the first time division control signal ASW1.

Moreover, a first transistor M1 of the second voltage controller 141B may be turned on based on a second time division control signal BSW1 and may provide the second time division control signal BSW1 to the second control line CL_B, and a capacitor Cbst of the second voltage controller 141B may bootstrap a voltage VA_B of the second control line CL_B on the basis of a second auxiliary signal BSW2 partially overlapping the second time division control signal BSW1.

Moreover, a first transistor M1 of the third voltage controller 141C may be turned on based on a third time division control signal CSW1 and may provide the third time division control signal CSW1 to the third control line CL_C, and a capacitor Cbst of the third voltage controller 141C may bootstrap a voltage VA_C of the third control line CL_C on the basis of a third auxiliary signal CSW2 partially overlapping the third time division control signal CSW1.

According to an embodiment, the first shift time of the first auxiliary signal ASW2 may correspond to a time between the first shift time and the second shift time of the first time division control signal ASW1, the first shift time of the second auxiliary signal BSW2 may correspond to a time between the first shift time and the second shift time of the second time division control signal BSW1, and the first shift time of the third auxiliary signal CSW2 may correspond to a time between the first shift time and the second shift time of the third time division control signal CSW1. Here, a first shift time of each of a plurality of signals may correspond to a rising edge and a second shift time of each signal may correspond to a falling edge, but the present disclosure is not limited thereto.

Therefore, the voltage VA_A of the first control line CL_A may primarily increase at a time when the first time division control signal ASW1 is applied and may be bootstrapped to secondarily increase at a time when the first auxiliary signal ASW2 is applied. Also, the voltage VA_B of the second control line CL_B may primarily increase at a time when the second time division control signal BSW1 is applied and may be bootstrapped to secondarily increase at a time when the second auxiliary signal BSW2 is applied. Also, the voltage VA_C of the third control line CL_C may primarily increase at a time when the third time division control signal CSW1 is applied and may be bootstrapped to secondarily increase at a time when the third auxiliary signal CSW2 is applied.

The voltages VA_A, VA_B, and VA_C of the first to third control lines CL_A, CL_B, and CL_C may respectively return to a before-bootstrapping voltage at the second shift times of the first to third auxiliary signals ASW2, BSW2, and CSW2.

The third transistor M3 of the first switching unit 143A may be turned on based on the voltage VA_A of the first control line CL_A and may provide a data signal DS, supplied from each of a plurality of output channels CH of the driving IC 123, to a first data line DL1, DL4, . . . , or DLn-2 among three data lines DL respectively corresponding to the plurality of output channels CH. Here, the data signal DS may include a first data signal DS1 provided to a red subpixel through the first data line DL1, DL4, . . . , or DLn-2 among the three data lines DL, a second data signal DS2 provided to a green subpixel through a second data line DL2, DL5, . . . , or DLn-1 among the three data lines DL, and a third data signal DS3 provided to a blue subpixel through a third data line DL3, DL6, . . . , or DLn among the three data lines DL. Each of the first to third data signals DS1 to DS3 may include gray level information about red, green, or blue light.

According to an embodiment, the third transistor M3 of the first switching unit 143A may be turned on from the first shift time of the first time division control signal ASW1 to the first shift time of the second time division control signal BSW1 and may provide the first data signal DS1 to the first data line DL1, DL4, . . . , or DLn-2 among the three data lines DL. In detail, the first control line CL_A may be charged by the first transistor M1 from an application time of the first time division control signal ASW1 and may be discharged by the second transistor M2 from an application time of the second time division control signal BSW1, and thus, may be turned on from the first shift time of the first time division control signal ASW1 to the first shift time of the second time division control signal BSW1.

Moreover, the third transistor M3 of the second switching unit 143B may be turned on based on the voltage VA_B of the second control line CL_B and may provide the second data signal DS2, supplied from each of the plurality of output channels CH of the driving IC 123, to the second data line DL2, DL5, . . . , or DLn-1 among the three data lines DL.

Moreover, the third transistor M3 of the third switching unit 143C may be turned on based on the voltage VA_C of the third control line CL_C and may provide the third data signal DS3, supplied from each of the plurality of output channels CH of the driving IC 123, to the third data line DL3, DL6, . . . , or DLn among the three data lines DL.

The first to third demultiplexer circuits 140A to 140C may control the voltages VA_A, VA_B, and VA_C of the first to third control lines CL_A, CL_B, and CL_C during a first period t1 corresponding to one horizontal period 1H, and thus, may sequentially turn on the first to third switching units 143A to 143C. Accordingly, the first to third demultiplexer circuits 140A to 140C may respectively provide the first to third data signals DS1 to DS3, provided from the data driver 120, to the first to third data lines DL1 to DL3.

Therefore, the display apparatus according to the present disclosure may include the demultiplexer circuit unit 140 connected to the three control lines CL_A, CL_B, and CL_C, and thus, comparing with a case where the display apparatus does not include the demultiplexer circuit unit 140, the number of output channels CH of the plurality of driving ICs 123 may decrease by ⅓ and a high-resolution image may be implemented.

The second transistor M2 of the first voltage discharger 145A may be turned on based on the second time division control signal BSW1 which does not overlap the first time division control signal ASW1 and may additionally discharge the voltage VA_A of the first control line CL_A, and the first discharging transistor M21 of the first voltage discharger 145A may be turned on based on the third time division control signal CSW1 which does not overlap the first time division control signal ASW1 and the second time division control signal BSW1 and may additionally discharge the voltage VA_A of the first control line CL_A.

Moreover, the second transistor M2 of the second voltage discharger 145B may be turned on based on the third time division control signal CSW1 and may additionally discharge the voltage VA_B of the second control line CL_B, and the first discharging transistor M21 of the second voltage discharger 145B may be turned on based on the first time division control signal ASW1 and may additionally discharge the voltage VA_B of the second control line CL_B.

Moreover, the second transistor M2 of the third voltage discharger 145C may be turned on based on the second time division control signal BSW1 and may additionally discharge the voltage VA_C of the third control line CL_C, and the first discharging transistor M21 of the third voltage discharger 145C may be turned on based on the first time division control signal ASW1 and may additionally discharge the voltage VA_C of the third control line CL_C.

Therefore, the first to third demultiplexer circuits 140A to 140C may each include the first discharging transistor M21, and thus, even when the second transistor M2 is degraded, the discharging efficiency of the voltages VA_A, VA_B, and VA_C of the first to third control lines CL_A, CL_B, and CL_C may be enhanced and the occurrence of a leakage current transferred to a light emitting device may be prevented. As a result, the demultiplexer circuit unit 140 may stably maintain an output of the third transistor M3 turned on based on each of the voltages VA_A, VA_B, and VA_C of the first to third control lines CL_A, CL_B, and CL_C, thereby preventing a luminance of a display panel from being reduced and implementing a high-resolution image displayed by the display panel.

According to an embodiment, an order in which the first to third switching units 143A to 143C are turned on may be changed at every one horizontal period 1H of the scan signal. For example, the demultiplexer circuit unit 140 may sequentially turn on the first to third switching units 143A to 143C during a first period t1 corresponding to a first one horizontal period 1H and may sequentially turn on the third switching unit 143C, the second switching unit 143B, and the first switching unit 143A during a second period t2 corresponding to a next one horizontal period 1H. Therefore, the first to third demultiplexer circuits 140A to 140C may provide data signals DS to pixels connected to a first gate line GL1 and first to third data lines DL1 to DL3 during the first period t1. Also, the first to third demultiplexer circuits 140A to 140C may provide data signals DS to pixels connected to a second gate line GL2 and the first to third data lines DL1 to DL3 during the second period t2.

In detail, the voltage VA_A of the first control line CL_A may be charged by the first time division control signal ASW1 and the first auxiliary signal ASW2 during a fore period of the first period t1. The voltage VA_A of the first control line CL_A may be discharged by the second time division control signal BSW1 applied thereto during a middle period of the first period t1 and may be additionally discharged by the third time division control signal CSW1. Therefore, the first demultiplexer circuit 140A may provide the first data signal DS1 to the first data line DL1, DL4, . . . , or DLn-2 during the fore period of the first period t1.

During the middle period of the first period t1, the voltage VA_B of the second control line CL_B may be charged by the second time division control signal BSW1 and the second auxiliary signal BSW2. The voltage VA_B of the second control line CL_B may be discharged by the third time division control signal CSW1 applied thereto during a latter period of the first period t1 and may be additionally discharged by the first time division control signal ASW1. Therefore, the second demultiplexer circuit 140B may provide the second data signal DS2 to the second data line DL2, DL5, . . . , or DLn-1 during the middle period of the first period t1.

During the latter period of the first period t1, the voltage VA_C of the third control line CL_C may be charged by the third time division control signal CSW1 and the third auxiliary signal CSW2. Here, the third time division control signal CSW1 and the third auxiliary signal CSW2 may maintain a high-level voltage from the latter period of the first period t1 to a fore period of the second period t2. Therefore, the voltage VA_C of the third control line CL_C may be maintained up to the fore period of the second period t2 corresponding to a next one horizontal period 1H via the latter period of the first period t1. That is, the third switching unit 143C of the third demultiplexer circuit 140C may maintain a turn-on state from the latter period of the first period t1 to the fore period of the second period t2.

As described above, the third demultiplexer circuit 140C may provide the third data signal DS3 to a pixel connected to the third data line DL3 and the first gate line GL1 during the latter period of the first period t1 and may provide the third data signal DS3 to a pixel connected to the third data line DL3 and a second gate line GL2 during the fore period of the second period t2. The voltage VA_C of the third control line CL_C may be discharged by the second time division control signal BSW1 applied thereto during a middle period of the second period t2 and may be additionally discharged by the first time division control signal ASW1.

During the middle period of the second period t2, the voltage VA_B of the second control line CL_B may be charged by the second time division control signal BSW1 and the second auxiliary signal BSW2. The voltage VA_B of the second control line CL_B may be discharged by the first time division control signal ASW1 applied thereto during a latter period of the second period t2 and may be additionally discharged by the third time division control signal CSW1. Therefore, the second demultiplexer circuit 140B may provide the second data signal DS2 to the second data line DL2, DL5, . . . , or DLn-1 during the middle period of the second period t2.

As described above, a discharging time of the voltage VA_B of the second control line CL_B may differ at adjacent first and second periods t1 and t2. For example, the voltage VA_B of the second control line CL_B may start to be discharged from an application time of the third time division control signal CSW1 during the first period t1 and may start to be discharged from an application time of the first time division control signal ASW1 during the second period t2. Therefore, the second demultiplexer circuit 140B according to the present disclosure may discharge the voltage VA_B of the second control line CL_B on the basis of the first and third time division control signals ASW1 and CSW1 for controlling the first and third control lines CL_A and CL_C which differs from the second control line CL_B, thereby decreasing the number of increases and decreases in the voltages VA_A, VA_B, and VA_C of the first to third control lines CL_A, CL_B, and CL_C and reducing power consumption.

Finally, during the latter period of the second period t2, the voltage VA_A of the first control line CL_A may be charged by the first time division control signal ASW1 and the first auxiliary signal ASW2. Here, the first time division control signal ASW1 and the first auxiliary signal ASW2 may maintain a high-level voltage from the latter period of the second period t2 to a fore period of a next horizontal period. Therefore, the voltage VA_A of the first control line CL_A may be maintained up to the fore period of the next horizontal period via the latter period of the second period t2. That is, the first switching unit 143A of the first demultiplexer circuit 140A may maintain a turn-on state from the latter period of the second period t2 to the fore period of the next horizontal period.

In this manner, the display apparatus according to the present disclosure may sequentially turn on the first to third switching units 143A to 143C during the first period t1 and may sequentially turn on the third switching unit 143C, the second switching unit 143B, and the first switching unit 143A during the second period t2. As a result, the display apparatus according to the present disclosure may oppositely change an order in which the first to third switching units 143A to 143C are turned on, at every one horizontal period 1H of the scan signal, thereby implementing RGB-BGR rendering and decreasing power consumption.

Figure 5:
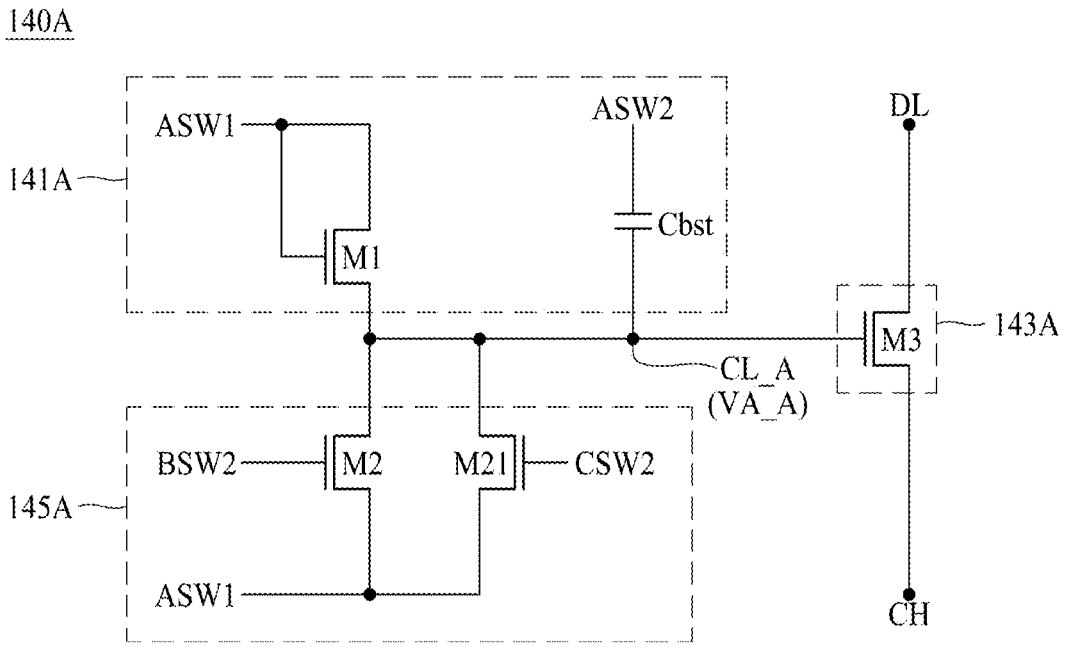
FIG. 5 is a circuit diagram illustrating a first demultiplexer circuit according to a second embodiment, in a demultiplexer circuit unit illustrated in FIG. 1.
Figure 6:
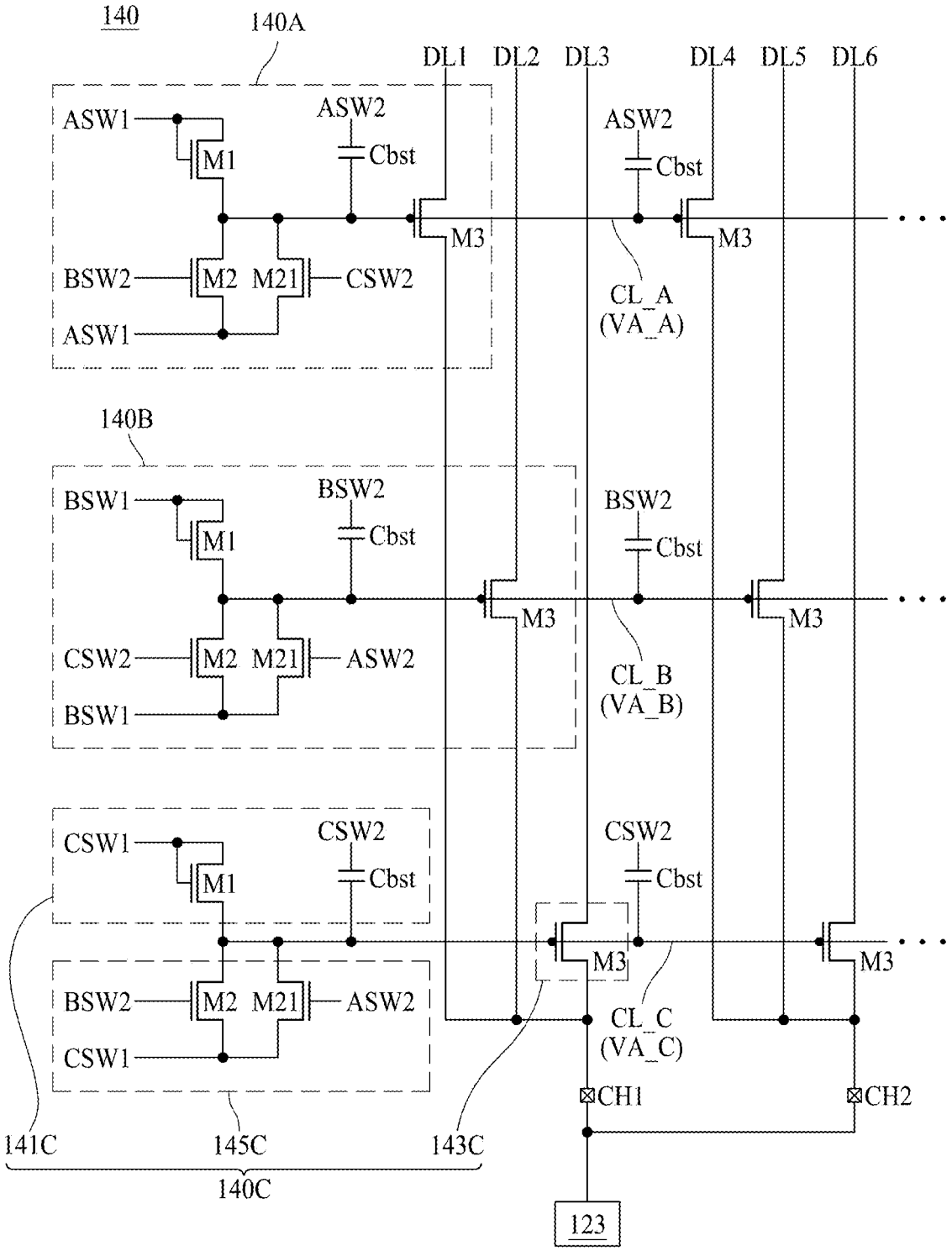
FIG. 6 is a circuit diagram illustrating an embodiment where first to third demultiplexer circuits drive a data line, in a demultiplexer circuit unit illustrated in FIG. 5.
Figure 7:
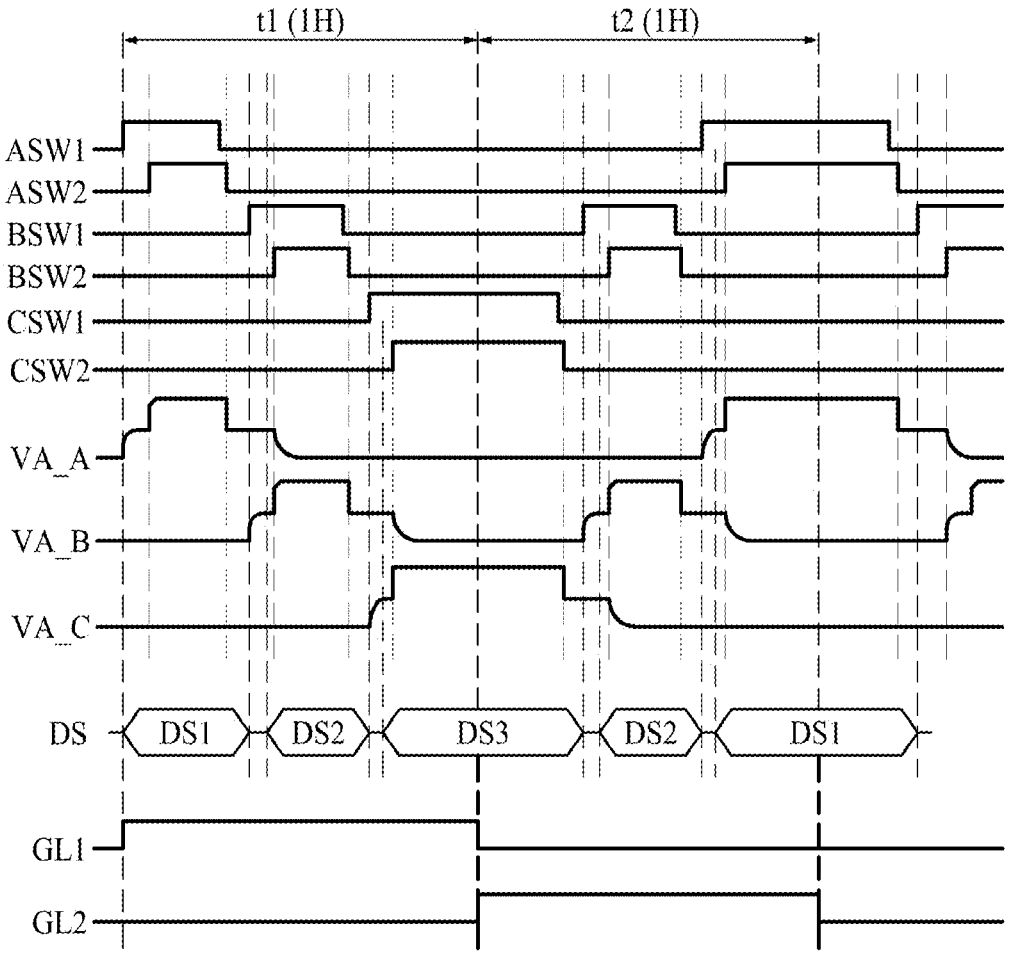
FIG. 7 is a waveform diagram showing signals provided to a demultiplexer circuit unit illustrated in FIG. 6.

FIG. 5 is a circuit diagram illustrating a first demultiplexer circuit according to a second embodiment, in a demultiplexer circuit unit illustrated in FIG. 1. FIG. 6 is a circuit diagram illustrating an embodiment where first to third demultiplexer circuits drive a data line, in a demultiplexer circuit unit illustrated in FIG. 5. FIG. 7 is a waveform diagram showing signals provided to a demultiplexer circuit unit illustrated in FIG. 6. Hereinafter, elements which are the same as those of the display apparatus according to the first embodiment of the present disclosure described above will be briefly described or are omitted.

Referring to FIGS. 5 to 7, a demultiplexer circuit unit 140 may include first to third demultiplexer circuits 140A to 140C respectively connected to three data lines DL.

The first to third demultiplexer circuits 140A to 140C may respectively include first to third voltage dischargers 145A to 145C which respectively discharge voltages VA_A, VA_B, and VA_C of first to third control lines CL_A, CL_B, and CL_C.

A second transistor M2 of the first voltage discharger 145A may be turned on based on a second auxiliary signal BSW2 which does not overlap a first auxiliary signal ASW2 and may discharge a voltage VA_A of a first control line CL_A, and a first discharging transistor M21 of the first voltage discharger 145A may be turned on based on a third auxiliary signal CSW2 which does not overlap the first and second auxiliary signals ASW2 and BSW2 and may additionally discharge the voltage VA_A of the first control line CL_A.

Moreover, a second transistor M2 of the second voltage discharger 145B may be turned on based on the third auxiliary signal CSW2 and may discharge a voltage VA_B of a second control line CL_B, and a first discharging transistor M21 of the second voltage discharger 145B may be turned on based on the first auxiliary signal ASW2 and may additionally discharge the voltage VA_B of the second control line CL_B.

Moreover, a second transistor M2 of the third voltage discharger 145C may be turned on based on the second auxiliary signal BSW2 and may discharge a voltage VA_C of a third control line CL_C, and a first discharging transistor M21 of the third voltage discharger 145C may be turned on based on the first auxiliary signal ASW2 and may additionally discharge the voltage VA_C of the third control line CL_C.

Therefore, the first to third demultiplexer circuits 140A to 140C may each include the first discharging transistor M21, and thus, even when the second transistor M2 is degraded, the discharging efficiency of the voltages VA_A, VA_B, and VA_C of the first to third control lines CL_A, CL_B, and CL_C may be enhanced and the occurrence of a leakage current transferred to a light emitting device may be prevented. As a result, the demultiplexer circuit unit 140 may stably maintain an output of the third transistor M3 turned on based on each of the voltages VA_A, VA_B, and VA_C of the first to third control lines CL_A, CL_B, and CL_C, thereby preventing a luminance of a display panel from being reduced and implementing a high-resolution image displayed by the display panel.

According to an embodiment, an order in which the first to third switching units 143A to 143C are turned on may be changed at every one horizontal period 1H of the scan signal. For example, the demultiplexer circuit unit 140 may sequentially turn on the first to third switching units 143A to 143C during a first period t1 and may sequentially turn on the third switching unit 143C, the second switching unit 143B, and the first switching unit 143A during a second period t2. Therefore, the first to third demultiplexer circuits 140A to 140C may provide data signals DS to pixels connected to a first gate line GL1 and first to third data lines DL1 to DL3 during the first period t1. Also, the first to third demultiplexer circuits 140A to 140C may provide data signals DS to pixels connected to a second gate line GL2 and the first to third data lines DL1 to DL3 during the second period t2.

In detail, the voltage VA_A of the first control line CL_A may be charged by a first time division control signal ASW1 and the first auxiliary signal ASW2 during a fore period of the first period t1. The voltage VA_A of the first control line CL_A may be discharged by the second auxiliary signal BSW2 applied thereto during a middle period of the first period t1 and may be additionally discharged by the third auxiliary signal CSW2. Therefore, the first demultiplexer circuit 140A may provide a first data signal DS1 to a first data line DL1, DL4, . . . , or DLn-2 during the fore period of the first period t1.

During the middle period of the first period t1, the voltage VA_B of the second control line CL_B may be charged by a second time division control signal BSW1 and the second auxiliary signal BSW2. The voltage VA_B of the second control line CL_B may be discharged by the third auxiliary signal CSW2 applied thereto during a latter period of the first period t1 and may be additionally discharged by the first auxiliary signal ASW2. Therefore, the second demultiplexer circuit 140B may provide a second data signal DS2 to a second data line DL2, DL5, . . . , or DLn-1 during the middle period of the first period t1.

During the latter period of the first period t1, the voltage VA_C of the third control line CL_C may be charged by the third time division control signal CSW1 and the third auxiliary signal CSW2. Here, the third time division control signal CSW1 and the third auxiliary signal CSW2 may maintain a high-level voltage from the latter period of the first period t1 to a fore period of the second period t2. Therefore, the voltage VA_C of the third control line CL_C may be maintained up to the fore period of the second period t2 via the latter period of the first period t1. That is, the third switching unit 143C of the third demultiplexer circuit 140C may maintain a turn-on state from the latter period of the first period t1 to the fore period of the second period t2.

As described above, the third demultiplexer circuit 140C may provide a third data signal DS3 to a pixel connected to a third data line DL3 and a first gate line GL1 during the latter period of the first period t1 and may provide the third data signal DS3 to a pixel connected to the third data line DL3 and a second gate line GL2 during the fore period of the second period t2. The voltage VA_C of the third control line CL_C may be discharged by the second auxiliary signal BSW2 applied thereto during a middle period of the second period t2 and may be additionally discharged by the first auxiliary signal ASW2.

During the middle period of the second period t2, the voltage VA_B of the second control line CL_B may be charged by the second time division control signal BSW1 and the second auxiliary signal BSW2. The voltage VA_B of the second control line CL_B may be discharged by the first auxiliary signal ASW2 applied thereto during a latter period of the second period t2 and may be additionally discharged by the third auxiliary signal CSW2. Therefore, the second demultiplexer circuit 140B may provide the second data signal DS2 to the second data line DL2, DL5, . . . , or DLn-1 during the middle period of the second period t2.

As described above, a discharging time of the voltage VA_B of the second control line CL_B may differ at adjacent first and second periods t1 and t2. For example, the voltage VA_B of the second control line CL_B may start to be discharged from an application time of the third auxiliary signal CSW2 during the first period t1 and may start to be discharged from an application time of the first auxiliary signal ASW2 during the second period t2. Therefore, the second demultiplexer circuit 140B according to the present disclosure may discharge the voltage VA_B of the second control line CL_B on the basis of the first and third auxiliary signals ASW2 and CSW2 for controlling the first and third control lines CL_A and CL_C which differs from the second control line CL_B, thereby decreasing the number of increases and decreases in the voltages VA_A, VA_B, and VA_C of the first to third control lines CL_A, CL_B, and CL_C and reducing power consumption.

Finally, during the latter period of the second period t2, the voltage VA_A of the first control line CL_A may be charged by the first time division control signal ASW1 and the first auxiliary signal ASW2. Here, the first time division control signal ASW1 and the first auxiliary signal ASW2 may maintain a high-level voltage from the latter period of the second period t2 to a fore period of a next horizontal period. Therefore, the voltage VA_A of the first control line CL_A may be maintained up to the fore period of the next horizontal period via the latter period of the second period t2. That is, the first switching unit 143A of the first demultiplexer circuit 140A may maintain a turn-on state from the latter period of the second period t2 to the fore period of the next horizontal period.

In this manner, the display apparatus according to the present disclosure may sequentially turn on the first to third switching units 143A to 143C during the first period t1 and may sequentially turn on the third switching unit 143C, the second switching unit 143B, and the first switching unit 143A during the second period t2. As a result, the display apparatus according to the present disclosure may oppositely change an order in which the first to third switching units 143A to 143C are turned on, at every one horizontal period 1H of the scan signal, thereby implementing RGB-BGR rendering and decreasing power consumption.

Figure 8:
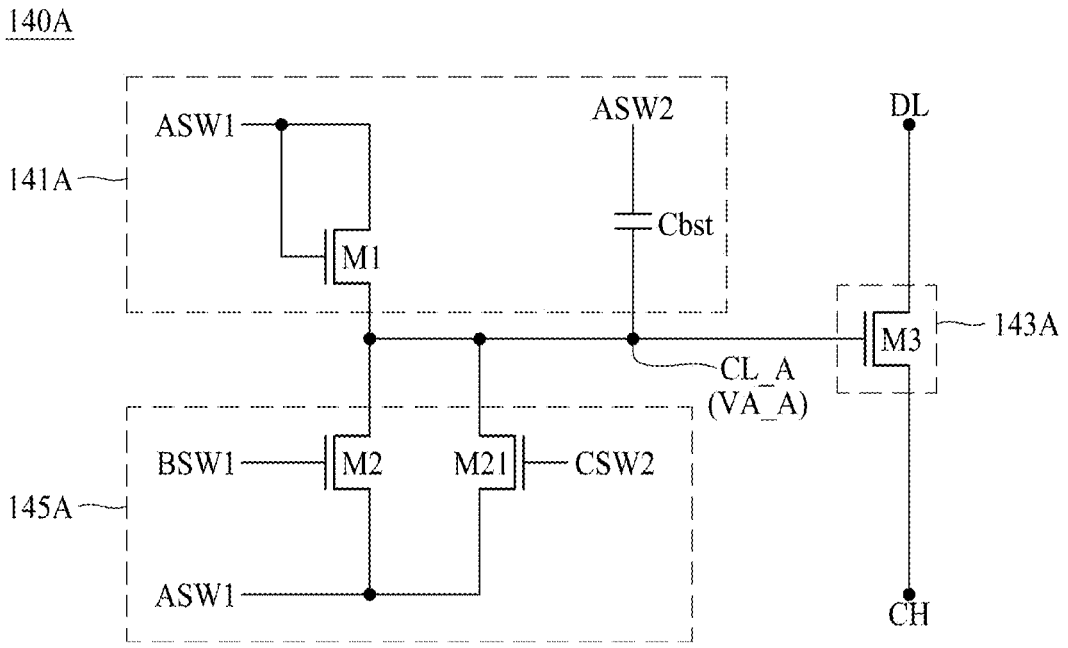
FIG. 8 is a circuit diagram illustrating a first demultiplexer circuit according to a third embodiment, in a demultiplexer circuit unit illustrated in FIG. 1.
Figure 9:
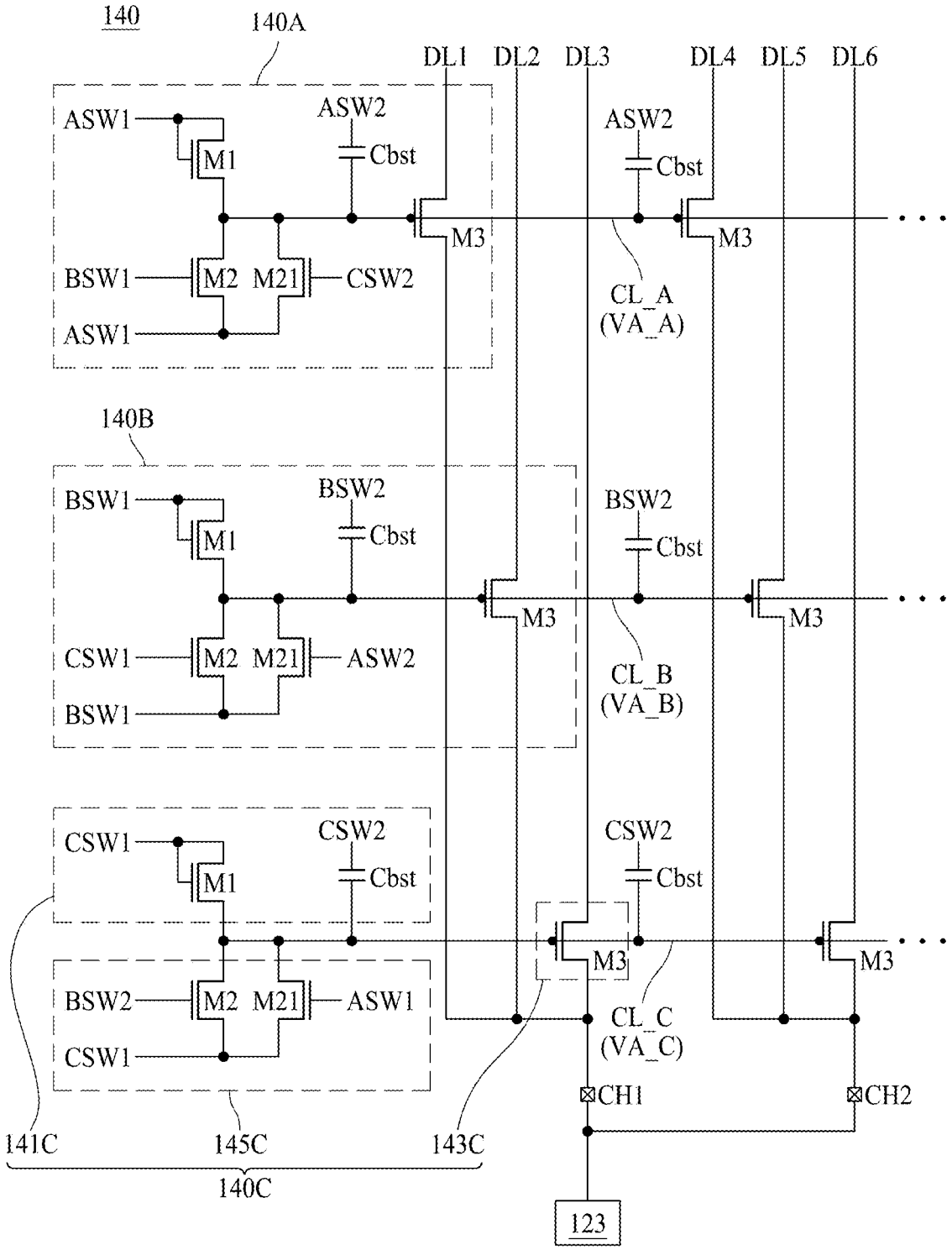
FIG. 9 is a circuit diagram illustrating an embodiment where first to third demultiplexer circuits drive a data line, in a demultiplexer circuit unit illustrated in FIG. 8.
Figure 10:
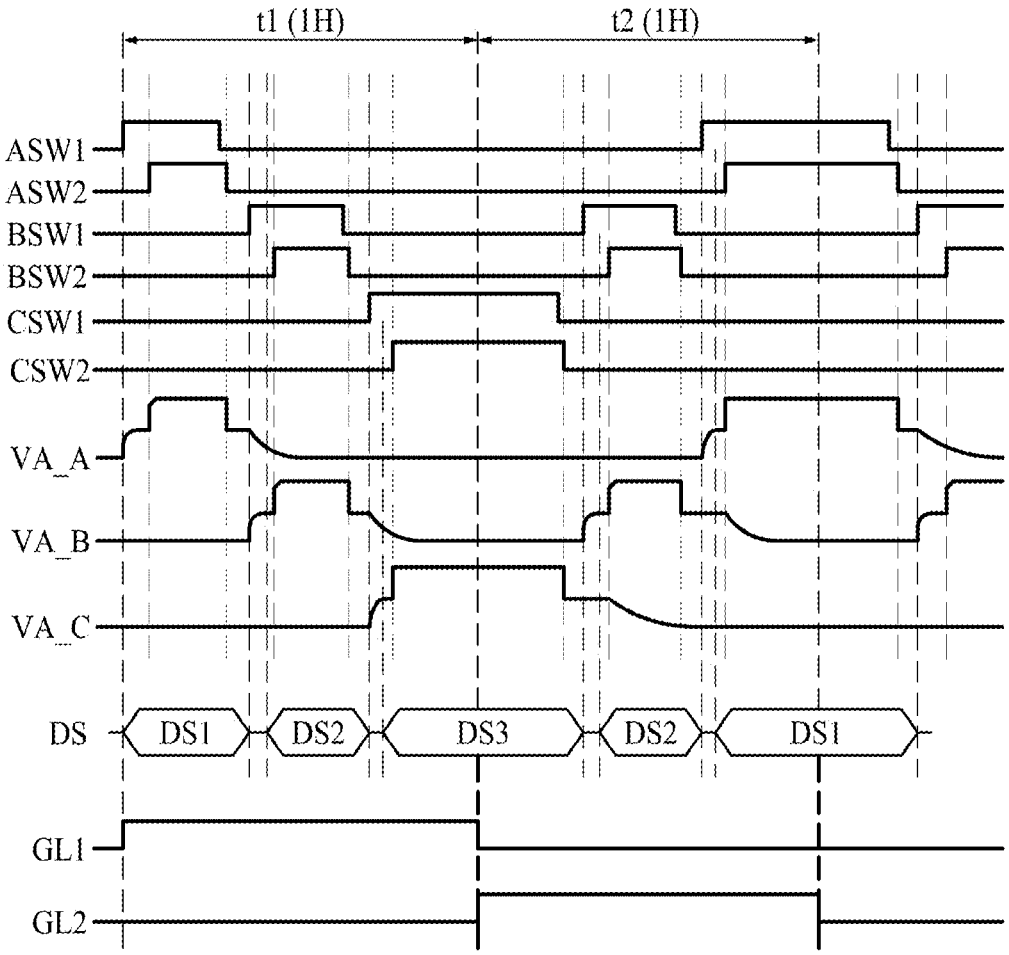
FIG. 10 is a waveform diagram showing signals provided to a demultiplexer circuit unit illustrated in FIG. 9.

FIG. 8 is a circuit diagram illustrating a first demultiplexer circuit according to a third embodiment, in a demultiplexer circuit unit illustrated in FIG. 1. FIG. 9 is a circuit diagram illustrating an embodiment where first to third demultiplexer circuits drive a data line, in a demultiplexer circuit unit illustrated in FIG. 8. FIG. 10 is a waveform diagram showing signals provided to a demultiplexer circuit unit illustrated in FIG. 9. Hereinafter, elements which are the same as those of the display apparatus according to the first and second embodiments of the present disclosure described above will be briefly described or are omitted.

Referring to FIGS. 8 to 10, a demultiplexer circuit unit 140 may include first to third demultiplexer circuits 140A to 140C respectively connected to three data lines DL.

The first to third demultiplexer circuits 140A to 140C may respectively include first to third voltage dischargers 145A to 145C which respectively discharge voltages VA_A, VA_B, and VA_C of first to third control lines CL_A, CL_B, and CL_C.

A second transistor M2 of the first voltage discharger 145A may be turned on based on a second time division control signal BSW1 which does not overlap a first time division control signal ASW1 and may discharge a voltage VA_A of a first control line CL_A, and a first discharging transistor M21 of the first voltage discharger 145A may be turned on based on a third auxiliary signal CSW2 which does not overlap first and second auxiliary signals ASW2 and BSW2 and may additionally discharge the voltage VA_A of the first control line CL_A.

Moreover, a second transistor M2 of the second voltage discharger 145B may be turned on based on a third time division control signal CSW1 which does not overlap the first and second time division control signals ASW1 and BSW1 and may discharge a voltage VA_B of a second control line CL_B, and a first discharging transistor M21 of the second voltage discharger 145B may be turned on based on the first auxiliary signal ASW2 and may additionally discharge the voltage VA_B of the second control line CL_B.

Moreover, a second transistor M2 of the third voltage discharger 145C may be turned on based on the second auxiliary signal BSW2 and may discharge a voltage VA_C of a third control line CL_C, and a first discharging transistor M21 of the third voltage discharger 145C may be turned on based on the first time division control signal ASW1 and may additionally discharge the voltage VA_C of the third control line CL_C.

Therefore, the first to third demultiplexer circuits 140A to 140C may each include the first discharging transistor M21, and thus, even when the second transistor M2 is degraded, the discharging efficiency of the voltages VA_A, VA_B, and VA_C of the first to third control lines CL_A, CL_B, and CL_C may be enhanced and the occurrence of a leakage current transferred to a light emitting device may be prevented. As a result, the demultiplexer circuit unit 140 may stably maintain an output of the third transistor M3 turned on based on each of the voltages VA_A, VA_B, and VA_C of the first to third control lines CL_A, CL_B, and CL_C, thereby preventing a luminance of a display panel from being reduced and implementing a high-resolution image displayed by the display panel.

According to an embodiment, an order in which the first to third switching units 143A to 143C are turned on may be changed at every one horizontal period 1H of the scan signal. For example, the demultiplexer circuit unit 140 may sequentially turn on the first to third switching units 143A to 143C during a first period t1 and may sequentially turn on the third switching unit 143C, the second switching unit 143B, and the first switching unit 143A during a second period t2. Therefore, the first to third demultiplexer circuits 140A to 140C may provide data signals DS to pixels connected to a first gate line GL1 and first to third data lines DL1 to DL3 during the first period t1. Also, the first to third demultiplexer circuits 140A to 140C may provide data signals DS to pixels connected to a second gate line GL2 and the first to third data lines DL1 to DL3 during the second period t2.

In detail, the voltage VA_A of the first control line CL_A may be charged by a first time division control signal ASW1 and the first auxiliary signal ASW2 during a fore period of the first period t1. The voltage VA_A of the first control line CL_A may be discharged by the second time division control signal BSW1 applied thereto during a middle period of the first period t1 and may be additionally discharged by the third auxiliary signal CSW2. Therefore, the first demultiplexer circuit 140A may provide a first data signal DS1 to a first data line DL1, DL4, . . . , or DLn-2 during the fore period of the first period t1.

During the middle period of the first period t1, the voltage VA_B of the second control line CL_B may be charged by a second time division control signal BSW1 and the second auxiliary signal BSW2. The voltage VA_B of the second control line CL_B may be discharged by the third time division control signal CSW1 applied thereto during a latter period of the first period t1 and may be additionally discharged by the first auxiliary signal ASW2. Therefore, the second demultiplexer circuit 140B may provide a second data signal DS2 to a second data line DL2, DL5, . . . , or DLn-1 during the middle period of the first period t1.

During the latter period of the first period t1, the voltage VA_C of the third control line CL_C may be charged by the third time division control signal CSW1 and the third auxiliary signal CSW2. Here, the third time division control signal CSW1 and the third auxiliary signal CSW2 may maintain a high-level voltage from the latter period of the first period t1 to a fore period of the second period t2. Therefore, the voltage VA_C of the third control line CL_C may be maintained up to the fore period of the second period t2 via the latter period of the first period t1. That is, the third switching unit 143C of the third demultiplexer circuit 140C may maintain a turn-on state from the latter period of the first period t1 to the fore period of the second period t2.

As described above, the third demultiplexer circuit 140C may provide a third data signal DS3 to a pixel connected to a third data line DL3 and a first gate line GL1 during the latter period of the first period t1 and may provide the third data signal DS3 to a pixel connected to the third data line DL3 and a second gate line GL2 during the fore period of the second period t2. The voltage VA_C of the third control line CL_C may be discharged by the second auxiliary signal BSW2 applied thereto during a middle period of the second period t2 and may be additionally discharged by the first time division control signal ASW1.

During the middle period of the second period t2, the voltage VA_B of the second control line CL_B may be charged by the second time division control signal BSW1 and the second auxiliary signal BSW2. The voltage VA_B of the second control line CL_B may be discharged by the first auxiliary signal ASW2 applied thereto during a latter period of the second period t2 and may be additionally discharged by the third time division control signal CSW1. Therefore, the second demultiplexer circuit 140B may provide the second data signal DS2 to the second data line DL2, DL5, . . . , or DLn-1 during the middle period of the second period t2.

As described above, a discharging time of the voltage VA_B of the second control line CL_B may differ at adjacent first and second periods t1 and t2. For example, the voltage VA_B of the second control line CL_B may start to be discharged from an application time of the third time division control signal CSW1 during the first period t1 and may start to be discharged from an application time of the first auxiliary signal ASW2 during the second period t2. Therefore, the second demultiplexer circuit 140B according to the present disclosure may discharge the voltage VA_B of the second control line CL_B on the basis of the first auxiliary signal ASW2 and the third time division control signal CSW1 for controlling the first and third control lines CL_A and CL_C which differs from the second control line CL_B, thereby decreasing the number of increases and decreases in the voltages VA_A, VA_B, and VA_C of the first to third control lines CL_A, CL_B, and CL_C and reducing power consumption.

Finally, during the latter period of the second period t2, the voltage VA_A of the first control line CL_A may be charged by the first time division control signal ASW1 and the first auxiliary signal ASW2. Here, the first time division control signal ASW1 and the first auxiliary signal ASW2 may maintain a high-level voltage from the latter period of the second period t2 to a fore period of a next horizontal period. Therefore, the voltage VA_A of the first control line CL_A may be maintained up to the fore period of the next horizontal period via the latter period of the second period t2. That is, the first switching unit 143A of the first demultiplexer circuit 140A may maintain a turn-on state from the latter period of the second period t2 to the fore period of the next horizontal period.

In this manner, the display apparatus according to the present disclosure may sequentially turn on the first to third switching units 143A to 143C during the first period t1 and may sequentially turn on the third switching unit 143C, the second switching unit 143B, and the first switching unit 143A during the second period t2. As a result, the display apparatus according to the present disclosure may oppositely change an order in which the first to third switching units 143A to 143C are turned on, at every one horizontal period 1H of the scan signal, thereby implementing RGB-BGR rendering and decreasing power consumption.

Figure 11:
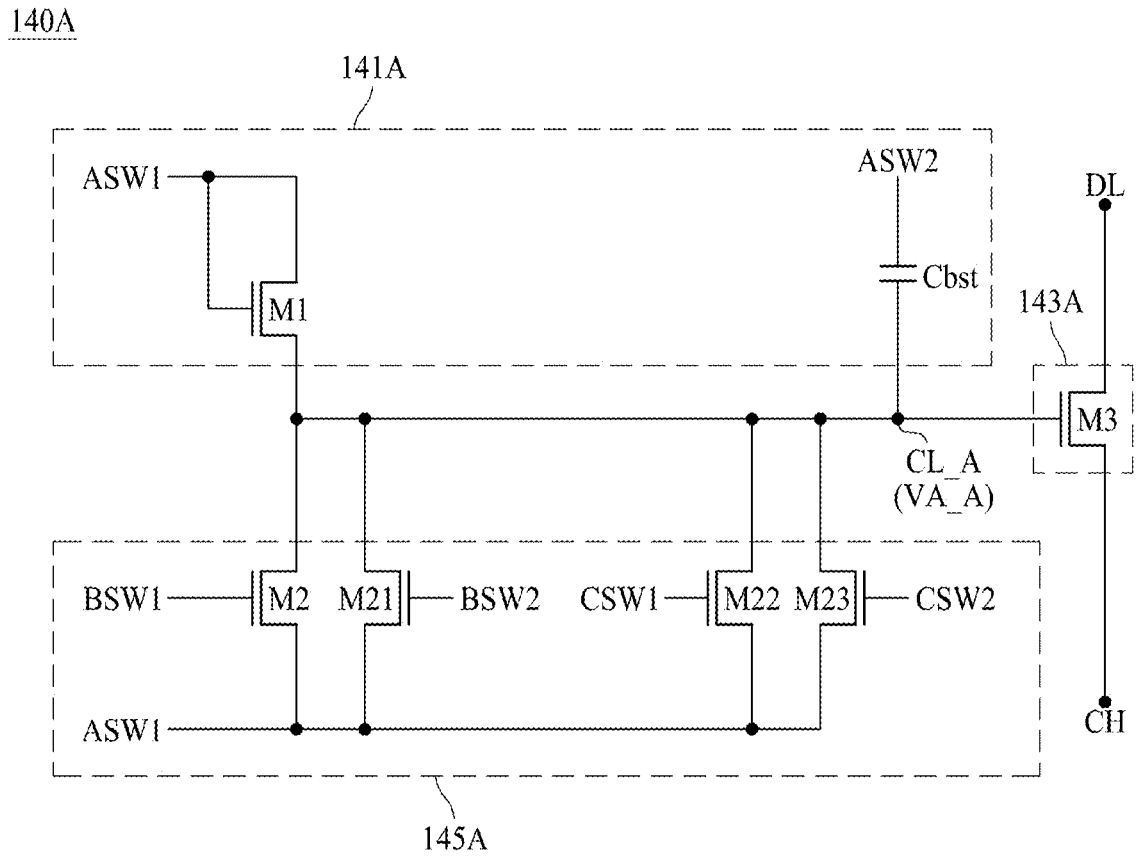
FIG. 11 is a circuit diagram illustrating a first demultiplexer circuit according to a fourth embodiment, in a demultiplexer circuit unit illustrated in FIG. 1.
Figure 12:
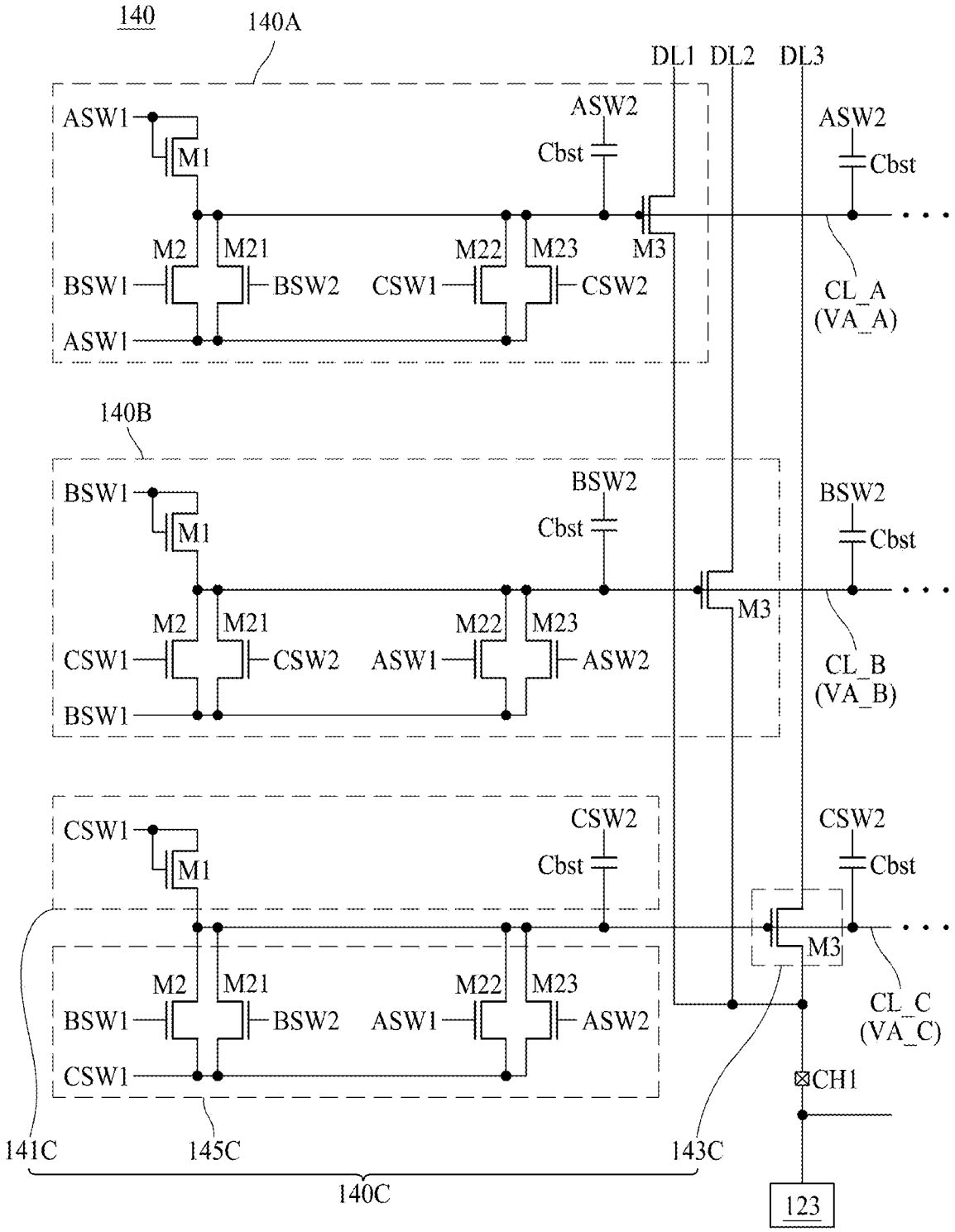
FIG. 12 is a circuit diagram illustrating an embodiment where first to third demultiplexer circuits drive a data line, in a demultiplexer circuit unit illustrated in FIG. 11.
Figure 13:
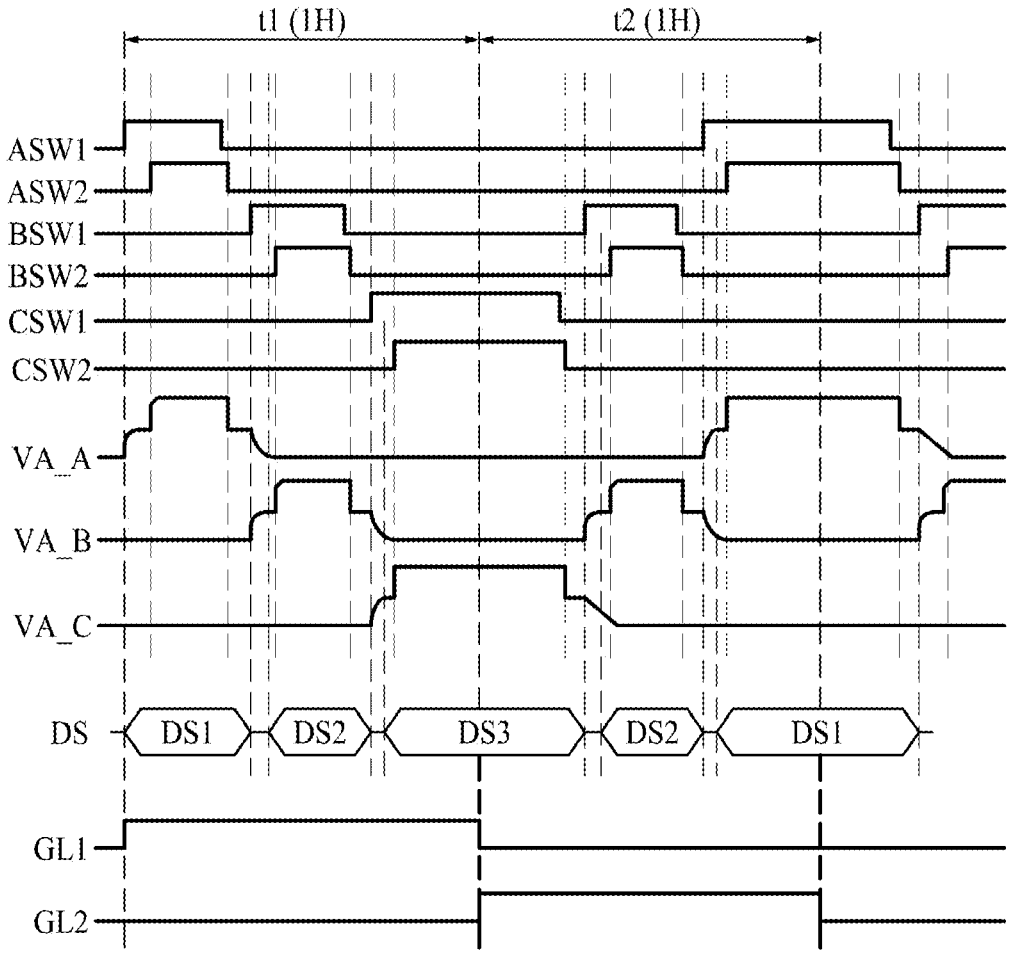
FIG. 13 is a waveform diagram showing signals provided to a demultiplexer circuit unit illustrated in FIG. 12.

FIG. 11 is a circuit diagram illustrating a first demultiplexer circuit according to a fourth embodiment, in a demultiplexer circuit unit illustrated in FIG. 1. FIG. 12 is a circuit diagram illustrating an embodiment where first to third demultiplexer circuits drive a data line, in a demultiplexer circuit unit illustrated in FIG. 11. FIG. 13 is a waveform diagram showing signals provided to a demultiplexer circuit unit illustrated in FIG. 12. Here, the first demultiplexer circuit according to the fourth embodiment may further include second and third discharging transistors M22 and M23, and elements which are the same as the above-described elements will be briefly described or are omitted.

Referring to FIG. 11, a demultiplexer circuit unit 140 may include first to third demultiplexer circuits 140A to 140C respectively connected to three data lines DL.

The first to third demultiplexer circuits 140A to 140C may respectively include first to third voltage dischargers 145A to 145C which respectively discharge voltages VA_A, VA_B, and VA_C of first to third control lines CL_A, CL_B, and CL_C.

The first voltage discharger 145A may include a second transistor M2 and first to third discharging transistors M21 to M23.

The second transistor M2 may be turned on based on a second time division control signal BSW1 and may discharge a voltage VA_A of a first control line CL_A. Therefore, when the second time division control signal BSW1 having a high-level voltage is applied to a gate electrode of the second transistor M2, the second transistor M2 may be turned on, and a first time division control signal ASW1 having a low-level voltage may be applied to a source electrode of the second transistor M2, whereby the voltage VA_A of the first control line CL_A may be discharged.

The first discharging transistor M21 may be turned on based on a second auxiliary signal BSW2 and may additionally discharge the voltage VA_A of the first control line CL_A. Therefore, the second transistor M2 may primarily discharge the voltage VA_A of the first control line CL_A on the basis of the second time division control signal BSW1, and then, the first discharging transistor M21 may secondarily discharge the voltage VA_A of the first control line CL_A on the basis of the second auxiliary signal BSW2, whereby the first voltage discharger 145A may enhance the discharging efficiency of the first demultiplexer circuit 140A to prevent the occurrence of a leakage current transferred to an organic light emitting device.

The second discharging transistor M22 may be turned on based on a third time division control signal CSW1 and may additionally discharge the voltage VA_A of the first control line CL_A. Therefore, the second transistor M2 and the first discharging transistor M21 may discharge the voltage VA_A of the first control line CL_A, and then, the second discharging transistor M22 may additionally discharge the voltage VA_A of the first control line CL_A, whereby the first voltage discharger 145A may enhance the discharging efficiency of the first demultiplexer circuit 140A to prevent the occurrence of a leakage current transferred to an organic light emitting device.

The third discharging transistor M23 may be turned on based on a third auxiliary signal CSW2 and may additionally discharge the voltage VA_A of the first control line CL_A. Therefore, the second transistor M2 and the first and second discharging transistors M21 and M22 may discharge the voltage VA_A of the first control line CL_A, and then, the third discharging transistor M23 may additionally discharge the voltage VA_A of the first control line CL_A, whereby the first voltage discharger 145A may enhance the discharging efficiency of the first demultiplexer circuit 140A to prevent the occurrence of a leakage current transferred to an organic light emitting device.

Referring to FIGS. 12 and 13, first to third demultiplexer circuits 140A to 140C may respectively include first to third voltage dischargers 145A to 145C which respectively discharge voltages VA_A, VA_B, and VA_C of first to third control lines CL_A, CL_B, and CL_C.

A second transistor M2 of the first voltage discharger 145A may be turned on based on a second time division control signal BSW1, a first discharging transistor M21 thereof may be turned on based on a second auxiliary signal BSW2, a second discharging transistor M22 thereof may be turned on based on a third time division control signal CSW1, and a third discharging transistor M23 thereof may be turned on based on a third auxiliary signal CSW2, thereby enhancing discharging efficiency corresponding to the voltage VA_A of the first control line CL_A.

Moreover, a second transistor M2 of the second voltage discharger 145B may be turned on based on a third time division control signal CSW1, a first discharging transistor M21 thereof may be turned on based on a third auxiliary signal CSW2, a second discharging transistor M22 thereof may be turned on based on a first time division control signal ASW1, and a third discharging transistor M23 thereof may be turned on based on a first auxiliary signal ASW2, thereby enhancing discharging efficiency corresponding to the voltage VA_B of the second control line CL_B.

Moreover, a second transistor M2 of the third voltage discharger 145C may be turned on based on the second time division control signal BSW1, a first discharging transistor M21 thereof may be turned on based on the second auxiliary signal BSW2, a second discharging transistor M22 thereof may be turned on based on the first time division control signal ASW1, and a third discharging transistor M23 thereof may be turned on based on the first auxiliary signal ASW2, thereby enhancing discharging efficiency corresponding to the voltage VA_C of the third control line CL_C.

Therefore, the first to third demultiplexer circuits 140A to 140C may each include the first to third discharging transistor M21 to M23, and thus, even when the second transistor M2 is degraded, the discharging efficiency of the voltages VA_A, VA_B, and VA_C of the first to third control lines CL_A, CL_B, and CL_C may be enhanced and the occurrence of a leakage current transferred to a light emitting device may be prevented. As a result, the demultiplexer circuit unit 140 may stably maintain an output of the third transistor M3 turned on based on each of the voltages VA_A, VA_B, and VA_C of the first to third control lines CL_A, CL_B, and CL_C, thereby preventing a luminance of a display panel from being reduced and implementing a high-resolution image displayed by the display panel.

According to an embodiment, an order in which the first to third switching units 143A to 143C are turned on may be changed at every one horizontal period 1H of a scan signal. For example, the demultiplexer circuit unit 140 may sequentially turn on the first to third switching units 143A to 143C during a first period t1 and may sequentially turn on the third switching unit 143C, the second switching unit 143B, and the first switching unit 143A during a second period t2. Therefore, the first to third demultiplexer circuits 140A to 140C may provide data signals DS to pixels connected to a first gate line GL1 and first to third data lines DL1 to DL3 during the first period t1. Also, the first to third demultiplexer circuits 140A to 140C may provide data signals DS to pixels connected to a second gate line GL2 and the first to third data lines DL1 to DL3 during the second period t2.

In detail, the voltage VA_A of the first control line CL_A may be charged by the first time division control signal ASW1 and the first auxiliary signal ASW2 during a fore period of the first period t1. The voltage VA_A of the first control line CL_A may be discharged by the first time division control signal ASW1 applied thereto during a middle period of the first period t1 and may be additionally discharged by the first auxiliary signal ASW2, the second time division control signal BSW1, and the second auxiliary signal BSW2. Therefore, the first demultiplexer circuit 140A may provide a first data signal DS1 to a first data line DL1, DL4, . . . , or DLn-2 during the fore period of the first period t1.

During the middle period of the first period t1, the voltage VA_B of the second control line CL_B may be charged by the second time division control signal BSW1 and the second auxiliary signal BSW2. The voltage VA_B of the second control line CL_B may be discharged by the third time division control signal CSW1 applied thereto during a latter period of the first period t1 and may be additionally discharged by the third auxiliary signal CSW2, the first time division control signal ASW1, and the first auxiliary signal ASW2. Therefore, the second demultiplexer circuit 140B may provide a second data signal DS2 to a second data line DL2, DL5, . . . , or DLn-1 during the middle period of the first period t1.

During the latter period of the first period t1, the voltage VA_C of the third control line CL_C may be charged by the third time division control signal CSW1 and the third auxiliary signal CSW2. Here, the third time division control signal CSW1 and the third auxiliary signal CSW2 may maintain a high-level voltage from the latter period of the first period t1 to a fore period of the second period t2. Therefore, the voltage VA_C of the third control line CL_C may be maintained up to the fore period of the second period t2 via the latter period of the first period t1. That is, the third switching unit 143C of the third demultiplexer circuit 140C may maintain a turn-on state from the latter period of the first period t1 to the fore period of the second period t2.

As described above, the third demultiplexer circuit 140C may provide a third data signal DS3 to a pixel connected to a third data line DL3 and a first gate line GL1 during the latter period of the first period t1 and may provide the third data signal DS3 to a pixel connected to the third data line DL3 and a second gate line GL2 during the fore period of the second period t2. The voltage VA_C of the third control line CL_C may be discharged by the second time division control signal BSW1 applied thereto during a middle period of the second period t2 and may be additionally discharged by the second auxiliary signal BSW2, the first time division control signal ASW1, and the first auxiliary signal ASW2.

During the middle period of the second period t2, the voltage VA_B of the second control line CL_B may be charged by the second time division control signal BSW1 and the second auxiliary signal BSW2. The voltage VA_B of the second control line CL_B may be discharged by the first time division control signal ASW1 applied thereto during a latter period of the second period t2 and may be additionally discharged by the first auxiliary signal ASW2, the third time division control signal CSW1, and the third auxiliary signal CSW2. Therefore, the second demultiplexer circuit 140B may provide the second data signal DS2 to the second data line DL2, DL5, . . . , or DLn-1 during the middle period of the second period t2.

As described above, a discharging time of the voltage VA_B of the second control line CL_B may differ at adjacent first and second periods t1 and t2. For example, the voltage VA_B of the second control line CL_B may start to be discharged from an application time of the third time division control signal CSW1 during the first period t1 and may start to be discharged from an application time of the first time division control signal ASW1 during the second period t2. Therefore, the second demultiplexer circuit 140B according to the present disclosure may discharge the voltage VA_B of the second control line CL_B on the basis of the first time division control signal ASW1 or the first auxiliary signal ASW2 for controlling the first control line CL_A differing from the second control line CL_B and the third time division control signal CSW1 or the third auxiliary signal CSW2 for controlling the third control line CL_C, thereby decreasing the number of increases and decreases in the voltages VA_A, VA_B, and VA_C of the first to third control lines CL_A, CL_B, and CL_C and reducing power consumption.

Finally, during the latter period of the second period t2, the voltage VA_A of the first control line CL_A may be charged by the first time division control signal ASW1 and the first auxiliary signal ASW2. Here, the first time division control signal ASW1 and the first auxiliary signal ASW2 may maintain a high-level voltage from the latter period of the second period t2 to a fore period of a next horizontal period. Therefore, the voltage VA_A of the first control line CL_A may be maintained up to the fore period of the next horizontal period via the latter period of the second period t2. That is, the first switching unit 143A of the first demultiplexer circuit 140A may maintain a turn-on state from the latter period of the second period t2 to the fore period of the next horizontal period.

In this manner, the display apparatus according to the present disclosure may sequentially turn on the first to third switching units 143A to 143C during the first period t1 and may sequentially turn on the third switching unit 143C, the second switching unit 143B, and the first switching unit 143A during the second period t2. As a result, the display apparatus according to the present disclosure may oppositely change an order in which the first to third switching units 143A to 143C are turned on, at every one horizontal period 1H of the scan signal, thereby implementing RGB-BGR rendering and decreasing power consumption.

As a result, in the display apparatus according to the present disclosure, the demultiplexer circuit unit 140 may change an order in which the first to third data signals DS1 to DS3 are respectively provided to the three data lines DL1 to DL3, at every one horizontal period 1H of the scan signal, thereby decreasing the number of increases and decreases in the voltages VA_A, VA_B, and VA_C of the first to third control lines CL_A, CL_B, and CL_C and reducing power consumption.

Moreover, the display apparatus according to the present disclosure may control the voltages VA_A, VA_B, and VA_C of the first to third control lines CL_A, CL_B, and CL_C on the basis of a corresponding time division control signal and a corresponding auxiliary signal among three time division control signals ASW1, BSW1, and CSW1 and three auxiliary signals ASW2, BSW2, and CSW2 and may vary a voltage of a corresponding control line on the basis of a time division control signal or an auxiliary signal for controlling a voltage of each of two different control lines, thereby decreasing the number of increases and decreases in a voltage of a control line and reducing power consumption.

The display apparatus according to the present disclosure may include a demultiplexer circuit unit for providing three data lines with a data signal provided from an output channel of a data driver and may change, by using the demultiplexer circuit unit, an order in which the data signal is provided to each of the three data lines, at every one horizontal period of a scan signal, thereby decreasing the number of increases and decreases in voltage of a control line and reducing power consumption.

Moreover, the display apparatus according to the present disclosure may control a voltage of a control line of each of first to third demultiplexer circuits on the basis of a corresponding time division control signal of three time division control signals and a corresponding auxiliary signal of three auxiliary signals and may discharge a voltage of a corresponding control line on the basis of a time division control signal or an auxiliary signal for controlling a voltage of each of two other control lines, thereby decreasing the number of increases and decreases in voltage of each control line and reducing power consumption.

Moreover, the display apparatus according to the present disclosure may oppositely change an order in which a switching unit of each of first to third demultiplexer circuits is turned on, at every one horizontal period of the scan signal, thereby implementing RGB-BGR rendering and reducing power consumption.

The above-described feature, structure, and effect of the present disclosure are included in at least one embodiment of the present disclosure, but are not limited to only one embodiment. Furthermore, the feature, structure, and effect described in at least one embodiment of the present disclosure may be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

What is claimed is:

1. A display apparatus, comprising:

first, second, and third demultiplexer circuits configured to respectively provide a data signal, supplied from a data driver, to first, second, and third data lines and receive six control signals including first, second, and third time division control signals and first, second, and third auxiliary signals, wherein each of the first, second, and third demultiplexer circuits comprises:

a switching transistor configured to provide the data signal to a corresponding data line of the first, second, and third data lines based on a voltage of a corresponding control line of first, second, and third control lines, a voltage controller including a first transistor and a capacitor configured to control the voltage of the corresponding control line in response to a corresponding time division control signal of the first, second, and third time division control signals and a corresponding auxiliary signal of the first, second, and third auxiliary signals, the first, second, and third auxiliary signals partially overlapping the first, second, and third time division control signals, respectively, and a voltage discharger including a second transistor and a first discharging transistor configured to discharge the voltage of the corresponding control line to a first level of the corresponding time division control signal in response to at least two among the first to third time division control signals and the first to third auxiliary signals, except for the corresponding time division control signal and the corresponding auxiliary signal, and wherein an order, in which the switching transistors of the first to third demultiplexer circuits are turned on, is to be oppositely changed at every one horizontal period of a scan signal, wherein the second transistor is configured to discharge the voltage of the corresponding control line during a first turn-on time in response to a first control signal, wherein the first discharging transistor is configured to discharge the voltage of the corresponding control line during a second turn-on time in response to a second control signal, the second turn-on time being different from the first turn-on time, and wherein the first control signal and the second control signal are different control signals among the six control signals and are to be supplied to the voltage controllers of demultiplexer circuits except a corresponding demultiplexer circuit.

2. The display apparatus of claim 1, wherein:

the second transistor of the second demultiplexer circuit is configured to be turned on based on the third time division control signal, which is supplied to the voltage controller of the third demultiplexer circuit, to discharge the second control line; and the first discharging transistor of the second demultiplexer circuit is configured to be turned on based on the first time division control signal, which is supplied to the voltage controller of the first demultiplexer circuit, to additionally discharge the second control line.

3. The display apparatus of claim 2, wherein:

the second transistor of the first demultiplexer circuit is configured to be turned on based on the second time division control signal, which is supplied to the voltage controller of the second demultiplexer circuit, to discharge the first control line; and the second transistor of the third demultiplexer circuit is configured to be turned on based on the second time division control signal, which is supplied to the voltage controller of the second demultiplexer circuit, to discharge the third control line.

4. The display apparatus of claim 3, wherein:

the first discharging transistor of the first demultiplexer circuit is configured to be turned on based on the third time division control signal to additionally discharge the first control line; and the first discharging transistor of the third demultiplexer circuit is configured to be turned on based on the first time division control signal to additionally discharge the third control line.

5. The display apparatus of claim 1, wherein:

the second transistor of the second demultiplexer circuit is configured to be turned on based on the third auxiliary signal, which is supplied to the voltage controller of the third demultiplexer circuit, to discharge the second control line; and the first discharging transistor of the second demultiplexer circuit is configured to be turned on based on the first auxiliary signal, which is supplied to the voltage controller of the first demultiplexer circuit, to additionally discharge the second control line.

6. The display apparatus of claim 5, wherein:

the second transistor of the first demultiplexer circuit is configured to be turned on based on the second auxiliary signal, which is supplied to the voltage controller of the second demultiplexer circuit, to discharge the first control line; and the second transistor of the third demultiplexer circuit is configured to be turned on based on the second auxiliary signal, which is supplied to the voltage controller of the second demultiplexer circuit, to discharge the third control line.

7. The display apparatus of claim 6, wherein:

the first discharging transistor of the first demultiplexer circuit is configured to be turned on based on the third auxiliary signal to additionally discharge the first control line; and the first discharging transistor of the third demultiplexer circuit is configured to be turned on based on the first auxiliary signal to additionally discharge the third control line.

8. The display apparatus of claim 1, wherein:

the second transistor of the second demultiplexer circuit is configured to be turned on based on the third time division control signal, which is supplied to the voltage controller of the third demultiplexer circuit, to discharge the second control line; and the first discharging transistor of the second demultiplexer circuit is configured to be turned on based on the first auxiliary signal, which is supplied to the voltage controller of the first demultiplexer circuit, to additionally discharge the second control line.

9. The display apparatus of claim 8, wherein:

the second transistor of the first demultiplexer circuit is configured to be turned on based on the second time division control signal, which is supplied to the voltage controller of the second demultiplexer circuit, to discharge the first control line; and the second transistor of the third demultiplexer circuit is configured to be turned on based on the second auxiliary signal, which is supplied to the voltage controller of the second demultiplexer circuit, to discharge the third control line.

10. The display apparatus of claim 9, wherein:

the first discharging transistor of the first demultiplexer circuit is configured to be turned on based on the third auxiliary signal, which is supplied to the voltage controller of the third demultiplexer circuit, to additionally discharge the first control line; and the first discharging transistor of the third demultiplexer circuit is configured to be turned on based on the first time division control signal, which is supplied to the voltage controller of the first demultiplexer circuit, to additionally discharge the third control line.

11. The display apparatus of claim 1, wherein:

the second transistor of the second demultiplexer circuit is configured to be turned on based on the third time division control signal, which is supplied to the voltage controller of the third demultiplexer circuit, to discharge the second control line;

the first discharging transistor configured to be turned on based on the third auxiliary signal, which is supplied to the voltage controller of the third demultiplexer circuit, to additionally discharge the second control line;

the voltage discharger of the second demultiplexer circuit further comprises:

a second discharging transistor configured to be turned on based on the first time division control signal, which is supplied to the voltage controller of the first demultiplexer circuit, to additionally discharge the second control line; and a third discharging transistor configured to be turned on based on the first auxiliary signal, which is supplied to the voltage controller of the first demultiplexer circuit, to additionally discharge the second control line.

12. The display apparatus of claim 11, wherein:

the second transistor of the first demultiplexer circuit is configured to be turned on based on the second time division control signal, which is supplied to the voltage controller of the second demultiplexer circuit, to discharge the first control line; and the first discharging transistor of the first demultiplexer circuit is configured to be turned on based on the second auxiliary signal, which is supplied to the voltage controller of the second demultiplexer circuit, to additionally discharge the first control line;

the second transistor of the third demultiplexer circuit is configured to be turned on based on the second time division control signal, which is supplied to the voltage controller of the second demultiplexer circuit, to discharge the third control line; and the first discharging transistor of the third demultiplexer circuit is configured to be turned on based on the second auxiliary signal, which is supplied to the voltage controller of the second demultiplexer circuit, to additionally discharge the third control line.

13. The display apparatus of claim 12, wherein:

the voltage discharger of the first demultiplexer circuit further comprises:

a second discharging transistor configured to be turned on based on the third time division control signal to additionally discharge the first control line; and a third discharging transistor configured to be turned on based on the third auxiliary signal to additionally discharge the first control line; and the voltage discharger of the third demultiplexer circuit further comprises:

a second discharging transistor configured to be turned on based on the first time division control signal to additionally discharge the third control line; and a third discharging transistor configured to be turned on based on the first auxiliary signal to additionally discharge the third control line.

14. The display apparatus of claim 1, wherein the first transistor is configured to be turned on based on a second level of the corresponding time division control signal to provide the second level of the corresponding time division control signal to the corresponding control line.

15. The display apparatus of claim 14, wherein the capacitor is configured to bootstrap the voltage of the corresponding control line based on a second level of the corresponding auxiliary signal of the first, second, and third auxiliary signals, which partially overlaps the second level of the corresponding one of the first, second, and third time division control signals.

16. The display apparatus of claim 1, wherein:

the switching transistors of the first, second, and third demultiplexer circuits are configured to be sequentially turned on during a first horizontal period of the scan signal; and the switching transistor of the third demultiplexer circuit is further configured to maintain a turn-on state up to a fore period of a second horizontal period of the scan signal.

17. The display apparatus of claim 16, wherein the switching transistors of the second demultiplexer circuit and the first demultiplexer circuit are configured to be turned on sequentially after the switching transistor of the third demultiplexer circuit.

18. A display apparatus, comprising:

first, second, and third demultiplexer circuits respectively providing a data signal, supplied from a data driver, to first, second, and third data lines;

wherein each of the first, second, and third demultiplexer circuits comprises:

a switching unit providing the data signal to a corresponding data line of the first, second, and third data lines on the basis of a voltage of each of first, second, and third control lines, a voltage controller controlling the voltage of each of the first, second, and third control lines in response to a corresponding time division control signal of first, second, and third time division control signals and a corresponding auxiliary signal of first, second, and third auxiliary signals, the first, second, and third auxiliary signals partially overlapping the first, second, and third time division control signals, respectively, and a voltage discharger discharging the voltage of a corresponding control line of the first, second, and third control lines to a first level of the corresponding time division control signal, and wherein the voltage discharger of the second demultiplexer circuit comprises:

a second-second transistor turned on during a first turn-on time based on the third time division control signal or the third auxiliary signal, which is supplied to the voltage controller of the third demultiplexer circuit, to discharge the second control line to a first level of the second time division control signal supplied to the voltage controller of the second demultiplexer circuit, and a second discharging transistor turned on during a second turn-on time based on the first time division control signal or the first auxiliary signal, which is supplied to the voltage controller of the first demultiplexer circuit, to additionally discharge the second control line to the first level of the second time division control signal, the second turn-on time being different from the first turn-on time.

19. The display apparatus of claim 18, wherein:

the voltage discharger of the first demultiplexer circuit comprises a first-second transistor configured to be turned on based on the second time division control signal or the second auxiliary signal, which is supplied to the voltage controller of the second demultiplexer circuit, to discharge the first control line to a first level of the first time division control signal supplied to the voltage controller of the first demultiplexer circuit; and the voltage discharger of the third demultiplexer circuit comprises a third-second transistor configured to be turned on based on the second time division control signal or the second auxiliary signal, which is supplied to the voltage controller of the second demultiplexer circuit, to discharge the third control line to a first level of the third time division control signal supplied to the voltage controller of the third demultiplexer circuit.

20. The display apparatus of claim 19, wherein:

the voltage discharger of the first demultiplexer circuit comprises a first discharging transistor configured to be turned on based on the third time division control signal or the third auxiliary signal to additionally discharge the first control line to a first level of the first time division control signal; and the voltage discharger of the third demultiplexer circuit comprises a third discharging transistor configured to be turned on based on the first time division control signal or the first auxiliary signal to additionally discharge the third control line to a first level of the third time division control signal.

* * * * *